US009325051B1

(12) United States Patent
Podell et al.

(10) Patent No.: US 9,325,051 B1
(45) Date of Patent: Apr. 26, 2016

(54) RESONANCE-INHIBITING TRANSMISSION-LINE NETWORKS AND JUNCTION

(71) Applicant: Werlatone, Inc., Brewster, NY (US)

(72) Inventors: Allen F. Podell, Palo Alto, CA (US); Ky-Hien Do, Mississauga (CA); Philip M. Robertson, III, New Milford, CT (US)

(73) Assignee: Werlatone, Inc., Patterson, NY (US)

( * ) Notice: Subject to any disclaimer, the term of this patent is extended or adjusted under 35 U.S.C. 154(b) by 0 days.

(21) Appl. No.: 14/677,887

(22) Filed: Apr. 2, 2015

(51) Int. Cl.

| | |
|---|---|
| ***H01P 5/12*** | (2006.01) |
| ***H01P 5/10*** | (2006.01) |
| ***H01P 3/08*** | (2006.01) |
| ***H01P 3/02*** | (2006.01) |

(52) U.S. Cl.
CPC *H01P 5/12* (2013.01); *H01P 3/026* (2013.01); *H01P 3/08* (2013.01); *H01P 5/10* (2013.01)

(58) Field of Classification Search
CPC ..... H01P 5/12; H01P 3/08; H01P 3/026; H01P 5/10
USPC ..... 333/125, 26, 238, 243
See application file for complete search history.

(56) References Cited

U.S. PATENT DOCUMENTS

| | | | |
|---|---|---|---|
| 2,470,307 | A | 5/1949 | Guanella |
| 3,091,743 | A | 5/1963 | Wilkinson |
| 3,239,781 | A | 3/1966 | Podell |
| 3,262,075 | A | 7/1966 | Podell |
| 3,311,850 | A | 3/1967 | Podell |
| 3,325,587 | A | 6/1967 | Sontheimer |
| 3,399,340 | A | 8/1968 | Podell |
| 3,484,724 | A | 12/1969 | Podell |
| 3,508,171 | A | 4/1970 | Podell |
| 3,516,025 | A | 6/1970 | Podell |
| 3,529,265 | A | 9/1970 | Podell |

(Continued)

FOREIGN PATENT DOCUMENTS

| | | | |
|---|---|---|---|
| CA | 742816 | A | 9/1966 |

OTHER PUBLICATIONS

Cohn, Seymour B. "A Class of Broadband Three-Port TEM-Mode Hybrids." IEEE Transactions on Microwave Theory and Techniques. vol. MTT-16, No. 2. Feb. 1968, pp. 110-116.

(Continued)

*Primary Examiner* — Robert Pascal
*Assistant Examiner* — Rakesh Patel
(74) *Attorney, Agent, or Firm* — Kolisch Hartwell, P.C.

(57) ABSTRACT

A transmission-line network may include a transmission-line sub-network. The sub-network may include at least first and second transmission lines having respective first ends connected electrically in series relative to a first circuit node and respective second ends connected electrically in parallel relative to a second circuit node. A third transmission line may have a first end directly connected to the second circuit node and a second end electrically connected to the second end of the first transmission line. A fourth transmission line may have a first end directly connected to the second circuit node and a second end electrically connected to the second end of the second transmission line. The transmission-line network may further include an impedance assembly disposed relative to the third and fourth transmission lines configured to produce resistance between the second end of the third transmission line and the second end of the fourth transmission line.

21 Claims, 10 Drawing Sheets

(56) References Cited

U.S. PATENT DOCUMENTS

| | | | | |
|---|---|---|---|---|
| 3,629,733 | A | | 12/1971 | Podell |
| 3,761,843 | A | | 9/1973 | Cappucci |
| 3,883,828 | A | | 5/1975 | Cappucci |
| 3,980,972 | A | | 9/1976 | Podell et al. |
| 3,988,705 | A | | 10/1976 | Drapac |
| 4,011,528 | A | | 3/1977 | Podell et al. |
| 4,129,838 | A | * | 12/1978 | Wallington ..... H01P 1/15 333/104 |
| 4,263,559 | A | | 4/1981 | Ho |
| 4,395,670 | A | | 7/1983 | Podell |
| 4,556,856 | A | | 12/1985 | Presser |
| 4,626,806 | A | | 12/1986 | Rosar et al. |
| 4,636,755 | A | | 1/1987 | Gibbs |
| 4,721,929 | A | | 1/1988 | Schnetzer |
| 4,800,345 | A | | 1/1989 | Podell et al. |
| 4,851,795 | A | | 7/1989 | Beckwith |
| 4,916,410 | A | * | 4/1990 | Littlefield ..... 330/295 |
| 4,937,541 | A | | 6/1990 | Podell et al. |
| 5,206,611 | A | | 4/1993 | Russell |
| 5,352,994 | A | | 10/1994 | Black et al. |
| 5,847,625 | A | | 12/1998 | Gillette |
| 5,889,444 | A | | 3/1999 | Johnson et al. |
| 5,926,076 | A | | 7/1999 | Johnson et al. |
| 5,982,252 | A | | 11/1999 | Werlau |
| 6,236,272 | B1 | | 5/2001 | Takei et al. |
| 6,246,299 | B1 | | 6/2001 | Werlau |
| 6,300,848 | B1 | | 10/2001 | Miyaji et al. |
| 6,407,648 | B1 | | 6/2002 | Johnson |
| 6,472,950 | B1 | | 10/2002 | London |
| 6,570,466 | B1 | | 5/2003 | Bahl |
| 6,750,752 | B2 | | 6/2004 | Werlau |
| 6,822,531 | B2 | | 11/2004 | Carlson |
| 6,972,639 | B2 | | 12/2005 | Podell |
| 7,042,309 | B2 | | 5/2006 | Podell |
| 7,132,906 | B2 | | 11/2006 | Podell |
| 7,138,887 | B2 | | 11/2006 | Podell |
| 7,142,052 | B2 | | 11/2006 | Zelley |
| 7,190,240 | B2 | | 3/2007 | Podell |
| 7,202,760 | B2 | | 4/2007 | Podell |
| 7,245,192 | B2 | | 7/2007 | Podell |
| 7,345,557 | B2 | | 3/2008 | Podell |
| 7,663,449 | B2 | | 2/2010 | Podell |
| 7,692,512 | B2 | | 4/2010 | Podell |
| 7,801,493 | B2 | | 9/2010 | Do |
| 8,248,180 | B2 | | 8/2012 | Podell |
| 8,248,181 | B2 | | 8/2012 | Podell |
| 8,482,362 | B1 | | 7/2013 | Podell |
| 8,493,162 | B1 | | 7/2013 | Podell |
| 8,570,116 | B2 | | 10/2013 | Podell |
| 8,598,964 | B2 | | 12/2013 | Podell |
| 8,648,669 | B1 | | 2/2014 | Podell |
| 8,704,611 | B2 | | 4/2014 | Podell et al. |
| 2008/0018412 | A1 | | 1/2008 | Podell |

OTHER PUBLICATIONS

Nagai, N., et al. "New n-Way Hybrid Power Dividers." Microwave Symposium Digest, 1977, IEEE MTT-S International Digital Object Indentifier. 1977, pp. 503-505.

Park, Ung-Hee, et al. "A 700- To 2500-MHz Microstrip Balun Using a Wilkinson Divider and 3-dB Quadrature Couplers." Microwave and Optical Technology Letters. vol. 47, No. 4. Nov. 20, 2005, pp. 333-335.

Harty, Daniel D. "Novel Design of a Wideband Ribcage-Dipole Array and its Feeding Network." Thesis Submitted to the Faculty of the Worcester Polytechnic Institute, Dec. 17, 2010, 106 pages.

* cited by examiner

RESONANCE-INHIBITING TRANSMISSION-LINE NETWORKS AND JUNCTION

BACKGROUND

A pair of conductive lines, such as a signal conductor and a signal-return conductor, are coupled when they are spaced apart, but spaced closely enough together for energy flowing in one to be induced in the other. The amount of energy flowing between the lines is related to the dielectric medium the conductors are in and the spacing between the lines. Even though electromagnetic fields surrounding the lines are theoretically infinite, lines are often referred to as being closely or tightly coupled, loosely coupled, or uncoupled, based on the relative amount of coupling. The amount of coupling may be defined by a coupling coefficient. However, as a practical measure, two lines may be considered to be inductively coupled when a detectable signal is coupled from one line onto the other. A threshold of coupling may be appropriate to distinguish between coupled and uncoupled lines. In most applications, two lines that have less than 20 dB inductive coupling between them are considered to be uncoupled lines, and are coupled lines otherwise. In some applications, lines that have less than 100 dB are considered to be uncoupled lines. In terms of a coupling coefficient, two lines may be considered to be closely coupled if the coupling coefficient is 0.1 or greater. Thus, two lines may be considered as loosely coupled or substantially uncoupled if they have a coupling coefficient of less than 0.1.

Transmission-line networks, such as impedance-transforming combiners (including dividers) and transformers, typically include such coupled lines, but may be restricted to limited frequency ranges of operation due to resonance inherently in their topologies. Some of these combiners/dividers and transformers may possess bandwidths with bandwidth ratios as great as 50:1 even when limited by inherent resonance.

A common characteristic of transmission-line networks, like impedance-transforming combiners and transformers, is the construction of junctions. Such junctions are formed by merging two or more transmission lines at a common point or junction. Where two transmission lines are merged the junction may be configured in the shape of a letter T, thus giving rise to the name T-junction. Under ideal conditions, when the two original transmission lines are strictly identical, usually a high Q resonance occurs at a single frequency. However, under realistic manufacturing conditions in which the two original lines are not exactly identical, the frequency response of a conventional T-junction is subject to a more pronounced (low Q) resonance.

SUMMARY OF THE DISCLOSURE

In one example, a transmission-line network may include a transmission-line sub-network extending between first and second circuit nodes. The transmission-line sub-network may include at least first and second transmission lines having common respective characteristic impedances and having respective lengths corresponding to a quarter wavelength of a circuit operating frequency of the transmission-line network. Respective first ends of the first and second transmission lines may be connected electrically in series relative to the first circuit node, and respective second ends of the first and second transmission lines may be connected electrically in parallel relative to the second circuit node. A third transmission line of the transmission-line network may have a first end directly connected to the second circuit node and a second end electrically connected to the second end of the first transmission line. A fourth transmission line of the transmission-line network may have a first end directly connected to the second circuit node and a second end electrically connected to the second end of the second transmission line. The transmission-line network may further include an impedance assembly disposed relative to the third and fourth transmission lines configured to produce resistance between the second end of the third transmission line and the second end of the fourth transmission line.

In another example, a circuit junction may include a first transmission line having a first characteristic impedance. The first transmission line may include a first signal conductor and at least a first signal-return conductor. The first signal conductor may have a first end connected to a first signal node and a second end connected to a second signal node. The first signal-return conductor may be electromagnetically closely coupled to the first signal conductor. The first signal-return conductor may have a first end connected to a first signal-return node and a second end connected to a second signal-return node.

The circuit junction may further include a second transmission line also having the first characteristic impedance. The second transmission line may include a second signal conductor and at least a second signal-return conductor. The second signal conductor may have a first end connected to the first signal node and a second end connected to a third signal node. The second signal-return conductor may have a first end connected to the first signal-return node and a second end connected to a third signal-return node. The second signal-return conductor may be spaced from the first signal-return conductor, and may be electromagnetically closely coupled to the second signal conductor. The second ends of the first and second signal-return conductors may be physically spaced apart. The first and second signal conductors may each have a length less than three-tenths of a wavelength of an operating frequency of the circuit junction.

The circuit junction may further include at least first and second tie signal-return conductors, an electrically conductive metal tie signal conductor, and a ferrite assembly. Each tie signal-return conductor may extend between the second and third signal-return nodes and may be discontinuous intermediate the second and third signal-return nodes at a respective gap. The tie signal conductor may be connected to and extend continuously between the second and third signal nodes. The tie signal conductor may also extend between the first and second tie signal-return conductors. The ferrite assembly may include at least first and second ferrite portions. The first ferrite portion may extend substantially along the first tie signal-return conductor opposite the tie signal conductor. The second ferrite portion may extend substantially along the second tie signal-return conductor opposite the tie signal conductor.

In another example, a transmission-line network may extend between first, second, and third circuit nodes. The transmission-line network may include a first transmission-line sub-network. The first transmission-line sub-network may include at least first and second transmission lines having common respective characteristic impedances and having respective lengths corresponding to a quarter wavelength of a circuit operating frequency of the transmission-line network. Respective first ends of the first and second transmission lines may be connected electrically in series relative to the first circuit node. Respective second ends of the first and second transmission lines may be connected electrically in parallel relative to a fourth circuit node. The transmission-line network may further include a second transmission-line sub-network including at least third and fourth transmission lines having common respective characteristic impedances and having respective lengths corresponding to the quarter wavelength. Respective first ends of the third and fourth transmission lines may be connected electrically in series relative to the third circuit node. Respective second ends of the third and fourth transmission lines may be connected electrically in parallel relative to a fifth circuit node. The transmission-line network may further include fifth and sixth transmission lines and an impedance assembly. The fifth transmission line may have a first end directly connected to the second circuit node and a second end directly connected to the fourth circuit node. The sixth transmission line may have a first end directly connected to the second circuit node and a second end directly connected to the fifth circuit node. The impedance assembly may be disposed relative to the fifth and sixth transmission lines and configured to produce resistance between the fourth circuit node and the fifth circuit node.

DETAILED DESCRIPTION OF VARIOUS EMBODIMENTS

In the designs of RF and microwave components, there are instances that a terminal is formed by merging two similar transmission lines together. The terminal thus takes on the characteristic impedance equal to half that of each of the original lines. The new terminal is termed a T-junction and normally its bandwidth performance is quite modest.

In particular, in the designs of impedance-transforming combiners and transformers, there are instances that a terminal is formed by such a T-junction. Furthermore, due to manufacturing tolerances and asymmetrical layouts, the performance of such combiners and transformers may be marred by a pronounced and persistent resonance at a frequency having a quarter wavelength equal to the length of each of the original transmission lines. As such, the upper ends of the operational bandwidths of pre-existing combiners and transformers are limited by these quarter wavelength resonances.

However, by joining transmission lines in a transmission-line network with a resistive junction as disclosed herein, it may be possible to significantly reduce the effects of the quarter-wave resonance. For example, the quarter-wave resonance may be reduced to a point that it no longer adversely impacts the insertion or return loss responses excessively. As a result, the bandwidth performance of such combiners and transformers may be improved extensively.

For example, a resistive junction may be included in a transmission-line network to overcome resonance due to series-parallel connections of transmission lines. Resistive junctions, such as those disclosed herein, may in some cases be useful when deployed in conjunction, for example, with a series-parallel transmission line transformer, balun, combiner, or other circuit.

Figure 3:
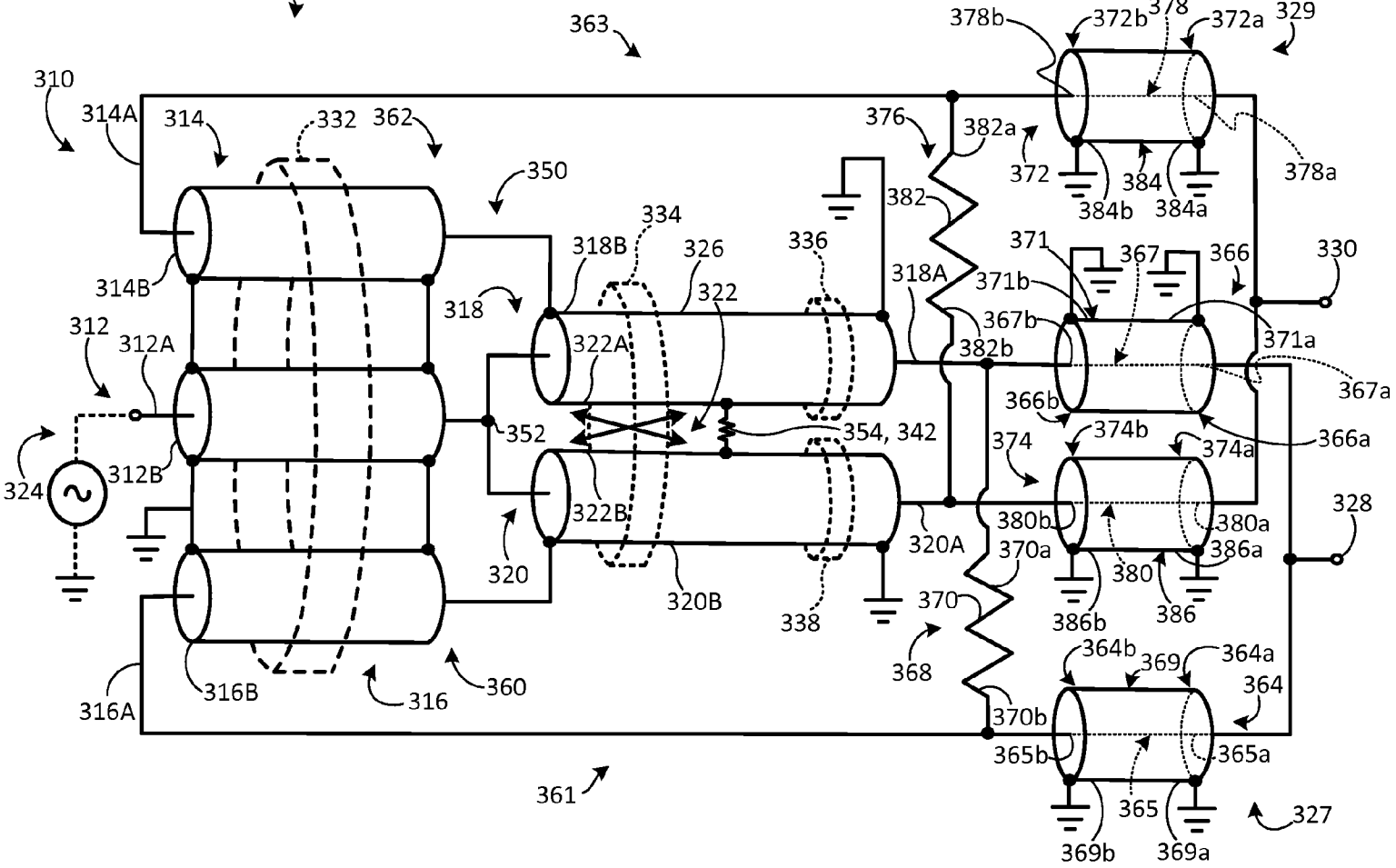
FIG. 3 is a semi-schematic diagram of an example of a transmission-line network including two transmission-line sub-networks and two resistive junctions.
Figure 5:
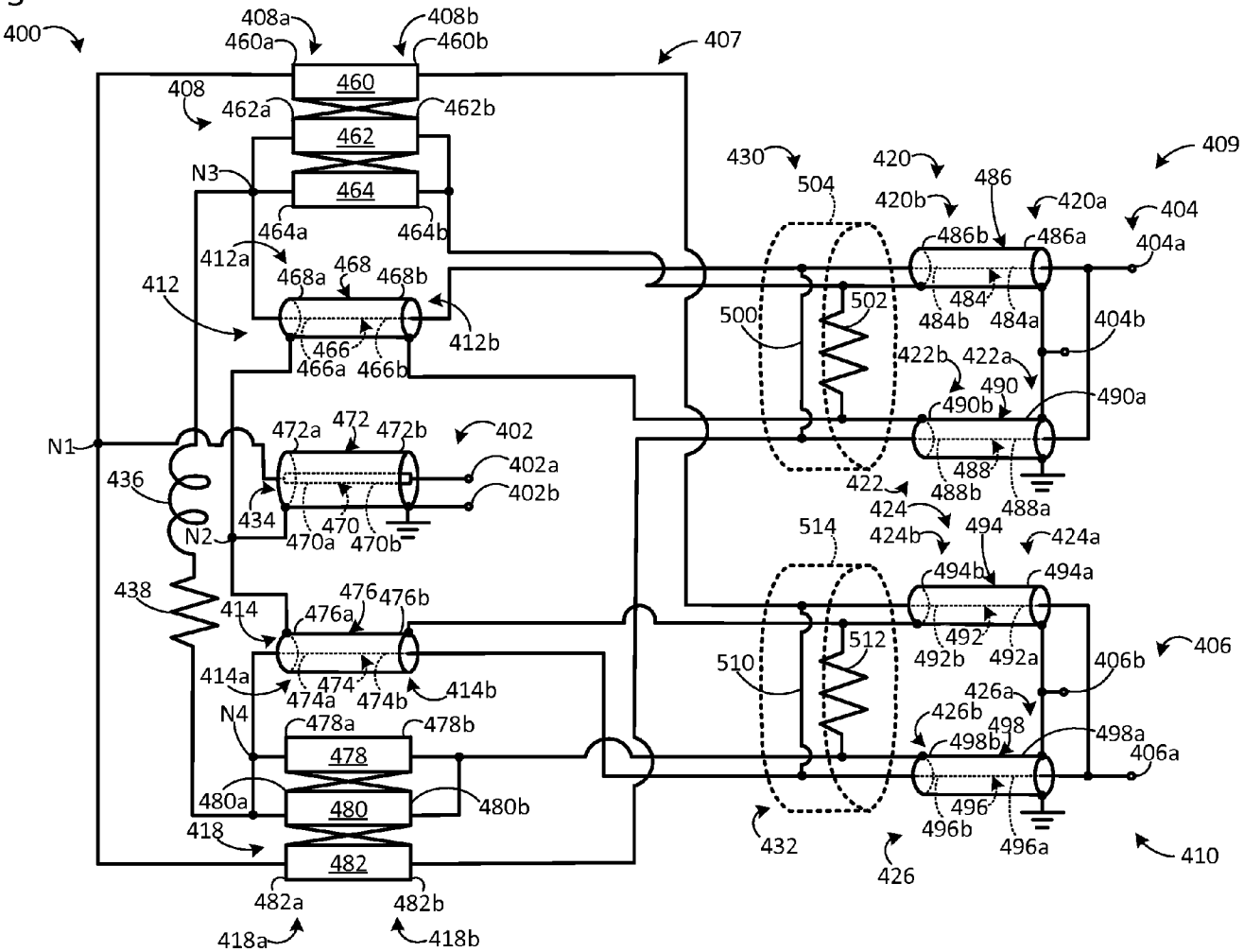
FIG. 5 is a semi-schematic diagram of another example of a transmission-line network including a transmission-line sub-network and two resistive junctions.
Figure 6:
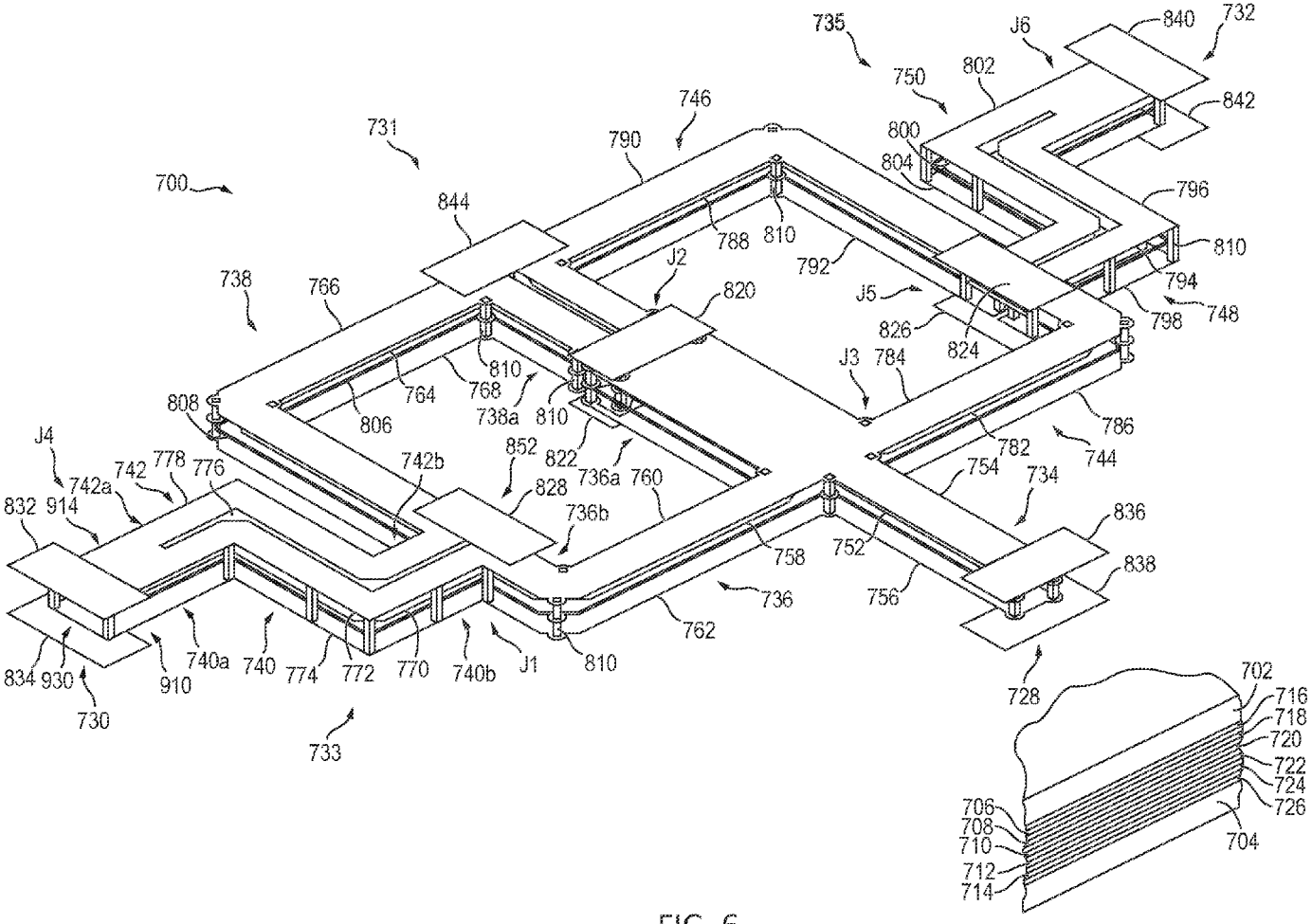
FIG. 6 is an isometric view of a planar embodiment of the transmission-line network of FIG. 5.
Figure 7:
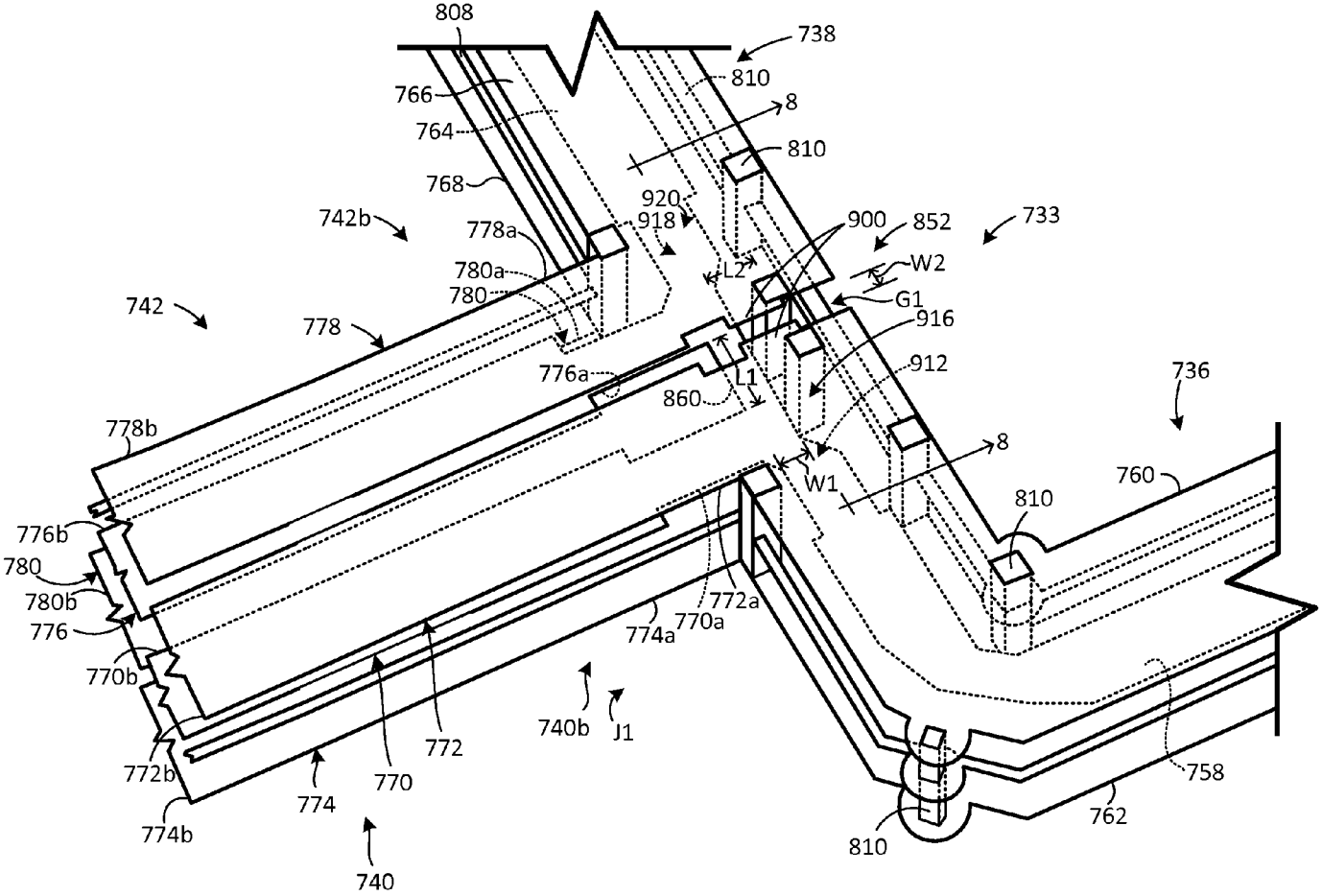
FIG. 7 is an isometric view of a portion of an impedance assembly of the planar embodiment of FIG. 6.
Figure 8:
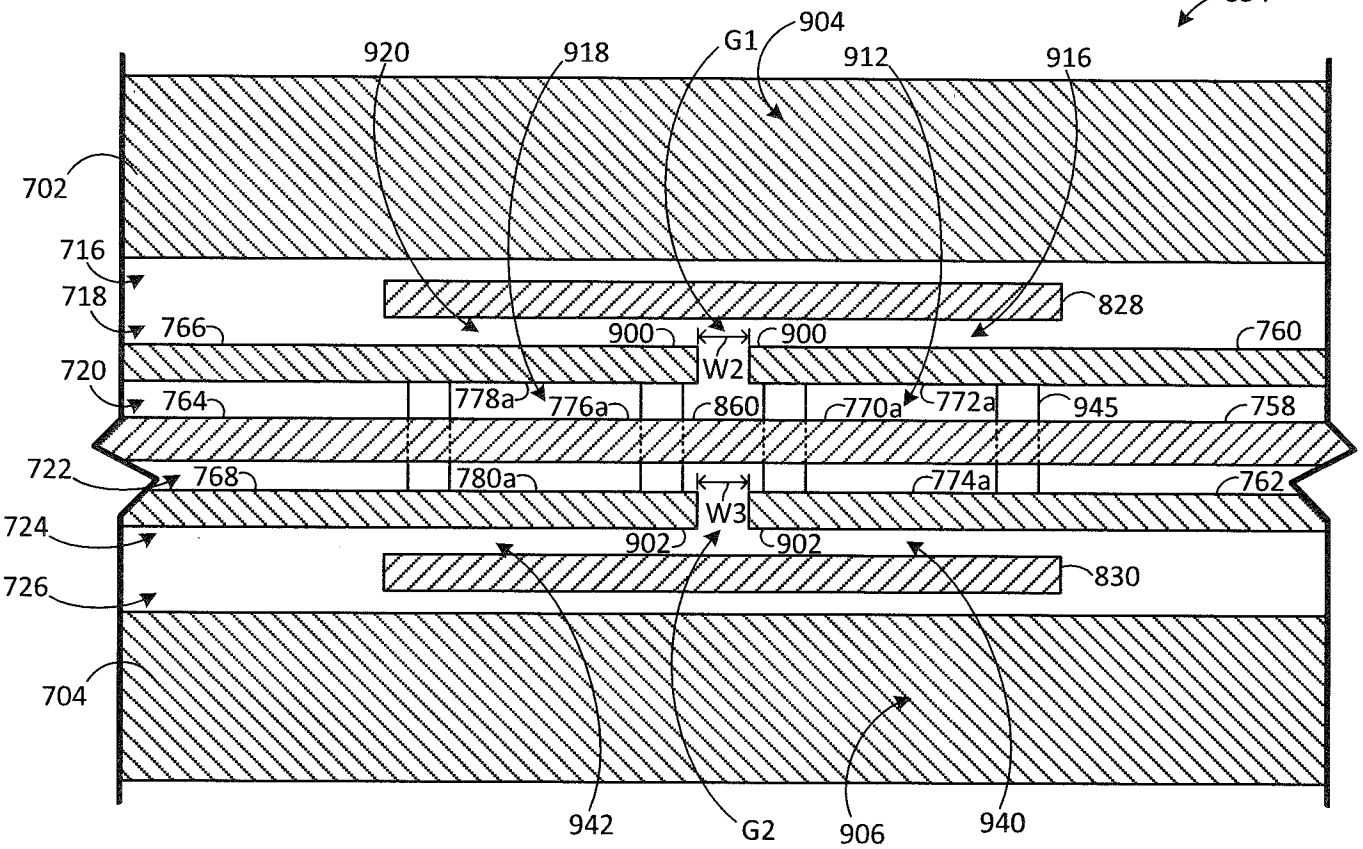
FIG. 8 is a cross-section of the planar embodiment taken along line 8-8 in FIG. 7.

Transmission lines disclosed herein may be constructed as one of various forms well known in the art. For example, a transmission line may be a coaxial transmission line, as shown in FIGS. 3 and 5, twisted pair, stripline, as shown in FIGS. 6-8, coplanar waveguide, slot line, or microstrip line. Whatever the form, each transmission line may include a pair of electrically spaced apart, inductively coupled conductors that conduct or transmit a signal defined by a voltage difference between the conductors. These conductors may be described interchangeably as a signal conductor and a signal-return conductor.

Figure 1:
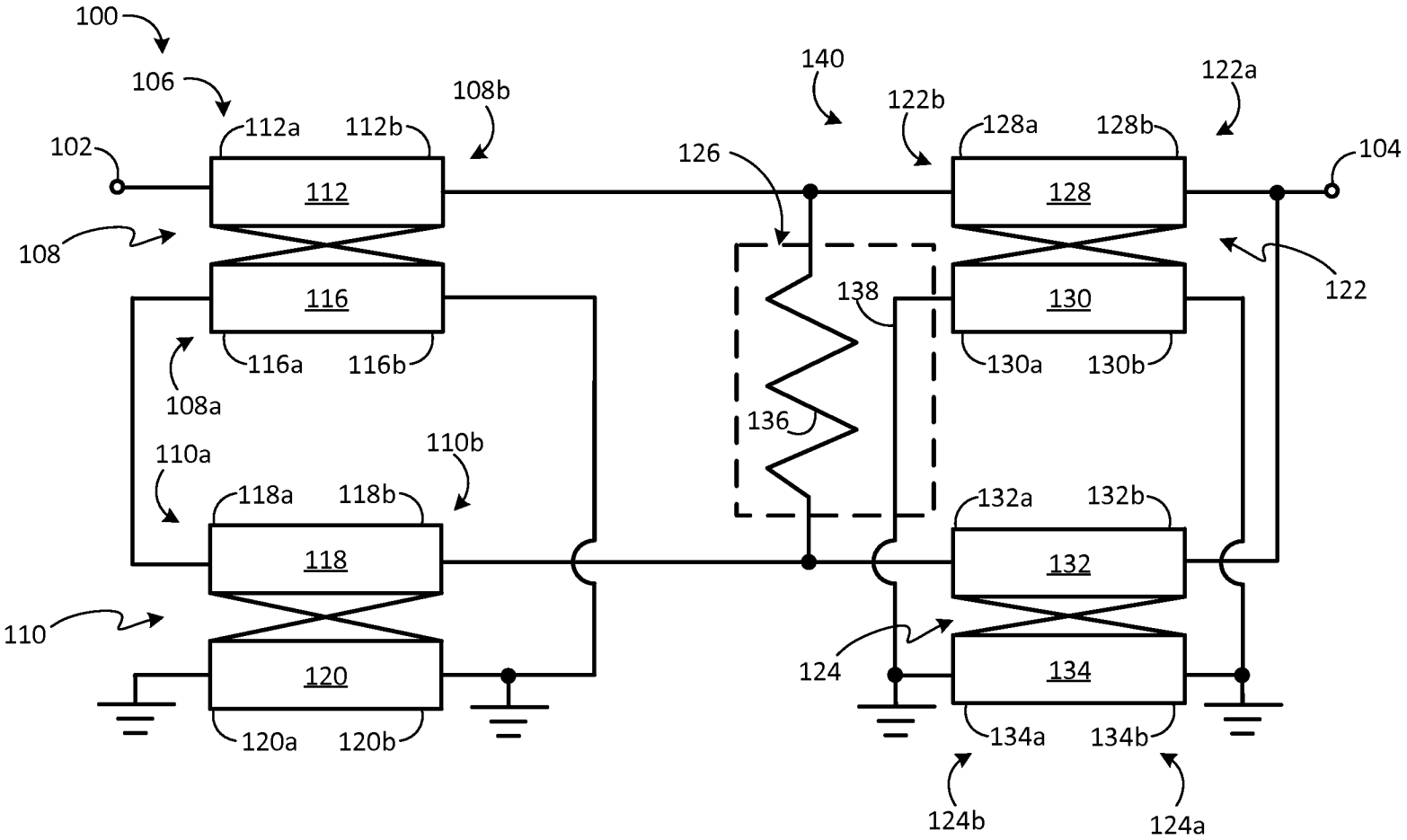
FIG. 1 is a schematic diagram of an example of a transmission-line network including a transmission-line sub-network and a resistive junction.

For example, FIG. 1 depicts one example of a transmission-line network 100 extending between first and second circuit nodes 102, 104. As shown, network 100 includes a transmission-line sub-network 106 based on an 4:1 impedance transformer as disclosed in U.S. Pat. No. 2,470,307. Sub-network 106 may include at least first and second transmission lines 108, 110. First transmission line 108 may include a signal conductor 112 and a signal-return conductor 116. Conductors 112, 116 may be closely electromagnetically coupled with one another. Similarly, second transmission line 110 may include a signal conductor 118 and a signal-return conductor 120. Conductors 118, 120 may be closely electromagnetically coupled with one another.

Network 100 may further include third and fourth transmission lines 122, 124, and an impedance assembly 126. Third transmission line 122 may include a signal conductor 128 and a signal-return conductor 130. Conductors 128, 130 may be closely electromagnetically coupled with one another. Similarly, fourth transmission line 124 may include a signal conductor 132 and a signal-return conductor 134. Conductors 132, 134 may be closely electromagnetically coupled with one another. Impedance assembly 126 may be configured to produce a resistance between respective ends of transmission lines 122, 124 (e.g., opposite node 104), as will be described further below in more detail. For instance, as shown in the immediate example, impedance assembly 126 may include a resistor 136 in combination with a connection 138 of (or between) signal-return conductors 130, 134. In some examples the resistance may be between the signal-return conductors or between both conductors of the associated transmission lines.

As can be seen in FIG. 1, the signal conductors and signal-return conductors of the transmission lines may each have respective first and second ends. In particular, signal conductors 112, 118, 128, 132 are shown as having respective first ends 112*a*, 118*a*, 128*a*, 132*a*, and respective second ends 112*b*, 118*b*, 128*b*, 132*b*. Similarly, signal-return conductors 116, 120, 130, 134 are shown as having respective first ends 116*a*, 120*a*, 130*a*, 134*a*, and respective second ends 116*b*, 120*b*, 130*b*, 134*b*.

Respective first ends 108*a*, 110*a* of transmission lines 108, 110 may be connected electrically in series relative to node 102. In particular, first ends 116*a*, 118*a* of respective signal-return conductor 116 and signal conductor 118 may be directly electrically connected together. First end 112*a* of signal conductor 112 may be electrically connected (e.g., directly electrically connected) to node 102. First end 120*a* of signal-return conductor 120 may be connected (e.g., directly) to ground.

Further, respective second ends 108*b*, 110*b* of transmission lines 108, 110 may be connected electrically in parallel relative to node 104. Second end 112*b* of signal conductor 112 may be electrically connected to node 104 (e.g., via signal conductor 128). Similarly, second end 118*b* of signal conductor 118 may be electrically connected to node 104 (e.g., via signal conductor 132). Second ends 116*b*, 120*b* of respective signal-return conductors 116, 120 may be connected (e.g., directly) to ground.

Third and fourth transmission lines 122, 124 may connect (or couple) sub-network 106 to node 104. In particular, third transmission line 122 may have a first end 122*a* directly connected to node 104, and a second end 122*b* electrically connected to second end 108*b* of first transmission line 108. Similarly, fourth transmission line 124 may have a first end 124*a* directly connected to node 104, and a second end 124*b* electrically connected to second end 110*b* of second transmission line 110. More specifically, second end 128*b* of signal conductor 128 may be directly electrically connected to node 104. First end 128*a* of signal conductor 128 may be electrically connected (e.g., directly electrically connected) to second end 112*b* of signal conductor 112. Second end 132*b* of signal conductor 132 may be directly electrically connected to node 104. First end 132*a* of signal conductor 132 may be electrically connected (e.g., directly electrically connected) to second end 118*b* of signal conductor 118. First ends 130*a*, 134*a* of respective signal-return conductors 130, 134 may be electrically connected to one another by connection 138, which may be connected (e.g., directly) to ground. Similarly, second ends 130*b*, 134*b* of respective signal-return conductors 130, 134 may be similarly connected (e.g., directly) to ground.

As shown, impedance assembly 126 may be disposed relative to third and fourth transmission lines 122, 124. Further, impedance assembly 126 may be configured to produce the resistance, as mentioned above, between second end 122*b* of third transmission line 122 and second end 124*b* of fourth transmission line 124. For example, as shown in FIG. 1, a first end of resistor 136 may be electrically connected (e.g., directly electrically connected) to first end 128*a* of signal conductor 128, and a second end of resistor 136 may be electrically connected (e.g., directly electrically connected) to first end 132*a* of signal conductor 132.

In some embodiments, third and fourth transmission lines 122, 124 may have the same characteristic impedances. Further, the resistance produced by impedance assembly 126 between second ends 122*b*, 124*b* of respective transmission lines 122, 124 may be at least half the magnitude of the characteristic impedances of transmission lines 122, 124. In some embodiments, such resistance produced by impedance assembly 126 may be twice the magnitude of the characteristic impedance of each of transmission lines 122, 124.

In some embodiments, third and fourth transmission lines 122, 124 may each have an electrical length that is a quarter wavelength or less of a circuit operating frequency of network 100. In some embodiments, the electrical length of each of transmission lines 122, 124 may be less than one-tenth of a wavelength of the circuit operating frequency of network 100.

It should be appreciated that in the embodiment depicted in FIG. 1, nodes 102, 104 may correspond to respective signal nodes. Connections to ground associated with second ends 130*b*, 134*b* of respective signal-return conductors 130, 134 may correspond to a signal-return node associated with signal node 104. Similarly, connection to ground associated with first end 120*a* of signal-return conductor 120 may correspond to a signal-return node associated with signal node 102.

More specifically, in one embodiment, port 102 may have an impedance of 100-Ohms, and port 104 may have an impedance of 25-Ohms. The characteristic impedance of transmission lines 108, 110 may be 50-Ohms. Resistor 136 may be a 100-Ohm resistor, and transmission lines 122, 124 may each have a characteristic impedance of 50-Ohms. The combination of resistor 136 and transmission lines 122, 124 may form a resistive junction 140 that provides at least two functions. First, the resistive junction may promote even mode propagation through it. Secondly, the resistive junction may substantially reduce the amount of quarter wavelength resonance.

For instance, if the lengths of lines 122, 124 are equal to a quarter wavelength of the resonant frequency of the transmission lines of sub-network 106, the operations of resistive junction 140 are as follows. At the resonant frequency, a short circuit occurring at signal-return conductor 116, on the parallel side (e.g., at end 116*b*), may repeat itself through a half wavelength transmission line (e.g., through signal-return conductor 116 and signal conductor 118 in series) to place a short circuit at end 132*a* of signal conductor 132 and at the associated second end of resistor 136. Signal conductor 132 may thus be "grounded" at one-end and may be a quarter wavelength long, therefore providing no loading to node 104. Transmission line 122 may also be a quarter wavelength long, and may transform the 25-Ohm port (e.g., node 104 relative to ground) to an impedance of 100-Ohms. Coincidentally, this 100-Ohm impedance is connected in parallel with resistor 136, which may also be 100-Ohms. As a result, a 50-Ohm equivalent impedance is created to offer a good match to the top 50-Ohm transmission line (e.g., line 122), even at a resonant frequency. The resistive junction thus counter-acts a seemingly 'unavoidable' resonance.

Furthermore, the resistance of resistor 136 can deviate from 100-Ohms, and the resonance may still be effectively mitigated. Similarly, the lengths of lines 122, 124 can be much less than a quarter wavelength (e.g., they can be as low as one sixteenth of a wavelength), and the resonance may still be effectively mitigated. Accordingly, resistive junctions described herein may compensate the short-comings of a purely conductive T-junctions of a parallel/series transmission-line sub-network.

Figure 2:
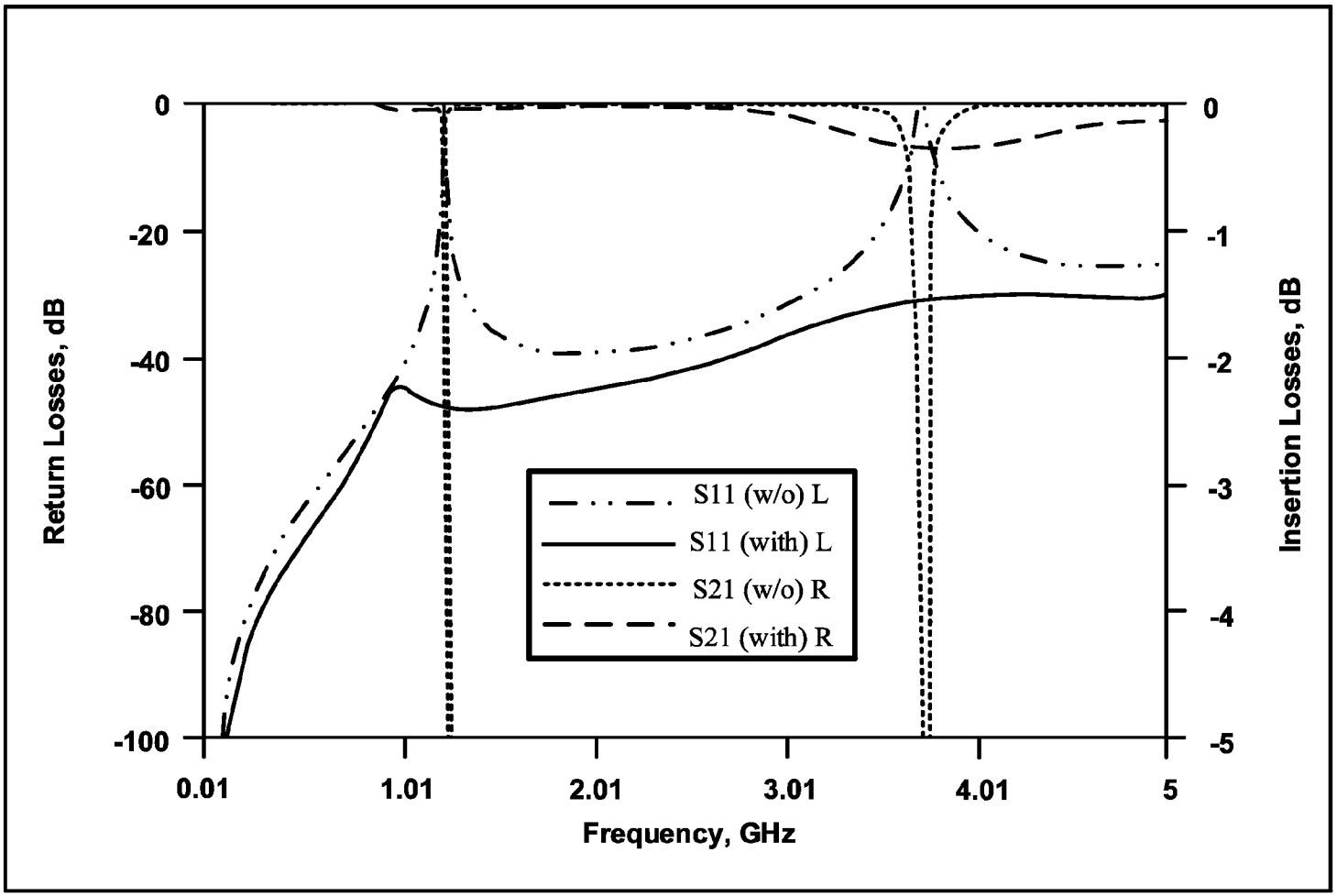
FIG. 2 is a chart illustrating simulated responses of the transmission-line network of FIG. 1 compared to a conventional Guanella transformer.

FIG. 2 illustrates a graph of a simulated performance of transmission-line network 100 as depicted in FIG. 1, as compared to network 100 with a T-junction instead of resistive junction 140, which network then corresponds to a conventional Guanella transformer. In the legend in FIG. 2, nodes 102, 104 are identified as nodes 1 and 2, respectively. The letters "R" and "L" in the legend indicate the "right" or "left" axis for the associated performance variable. Traces corresponding to the performance of network 100 (as depicted in FIG. 1) "with" resistive junction 140 are shown with a solid line trace and a long dash trace, as indicated in the legend. Traces corresponding to a performance of network 100 "without" resistive junction 140 are shown with a dash double-dot trace and a short dash trace, as also indicated in the legend.

As can be seen, network 100 "without" resistive junction 140 shows pronounced resonances at about 1.2 GHz and 3.8 GHZ, which limits its upper frequency range. On the other hand, network 100 "with" resistive junction 140 (e.g., with resistor 136 having a resistance of 75-Ohm, and lines 122, 124 each having an electrical length of one-sixteenth of a wavelength of an operating frequency of network 100) shows no ill effects at those resonant frequencies. In fact, the resistively compensated network 100 shows an upper frequency boundary of well beyond 3 GHz. More specifically, it can be seen that network 100 has an insertion loss (e.g., S21 "with") ranging from about 0.0 dB to −0.25 dB over a frequency range of about 1.0 GHz to 5.0 GHz. There is no lower frequency limit for this circuit, so the passband is from DC to 5 GHz. Also, the reflection coefficient or return loss at node 102 of network 100 (e.g., S11 "with"), is less than −30 dB over all of this passband.

FIG. 3 depicts another example of a transmission-line network 300 that may function as a combiner/divider. As depicted, network 300 may include a transmission-line sub-network 310 similar to the combiner/divider described in U.S. Pat. No. 8,493,162. In particular, transmission-line sub-network 310 may include a plurality of transmission lines such as first transmission line 312, second transmission line 314, third transmission line 316, fourth transmission line 318, fifth transmission line 320, and sixth transmission line 322. When used as a magic-tee hybrid combiner/divider, one end of a signal conductor 312A of transmission line 312 may be a sum port (or first circuit node) 324.

Signal-return conductors 318B and 320B of respective transmission lines 318 and 320 may form a difference port 326. One end of a signal conductor 316A of transmission line 316 may be connected to an end of a signal conductor 318A of transmission line 318 via a first resistive junction 327, which will be described further below in more detail. Such a connection (or coupling) of conductors 316A, 318A may be (or form, include, and/or be coupled to) a first component port (or second circuit node) 328.

Similarly, a first end of a signal conductor 314A of transmission line 314 may be connected to a first end of a signal conductor 320A of transmission line 320 via a second resistive junction 329, which also will be described further below in more detail. Similarly, such a connection (or coupling) of conductors 314A, 320A may be (or form, include, and/or be coupled to) a second component port (or third circuit node) 330.

Each port may be a place where characteristics of network 300 may be defined, whether accessible or not. A combiner/divider may also be referred to as a combiner/divider circuit, a divider/combiner, a divider, or a combiner, it being understood that signals and power may be conducted in either direction through them to either combine multiple inputs into a single output or to divide a single input into multiple outputs.

In FIG. 3, signal conductors of transmission-line sub-network 310 are given the designation "A" and signal-return conductors are given the designation "B." For example, the signal conductor of transmission line 312 is designated with reference numeral 312A and the signal-return conductor of transmission line 312 is designated with reference numeral 312B. Other transmission lines of transmission-line sub-network 310 are designated in similar fashion. Accordingly, transmission lines 314, 316, 318, 320, and 322 have signal conductors 314A, 316A, 318A, 320A, and 322A, and signal-return conductors 314B, 316B, 318B, 320B, and 322B. As is discussed further below, in this example, portions of signal return conductors 318B and 322B form signal conductor 322A and signal-return conductor 322B, respectively, of transmission line 322.

In some types of transmission lines a signal-return conductor may be a shield conductor, as in a coaxial transmission line, as shown in FIG. 3, or a stripline. A signal-return conductor may also be referred to as a ground conductor, whether or not it is connected to a local ground, a circuit ground, a system ground, or an earth ground. A signal conductor may be referred to as a shielded conductor or as a center conductor, such as in a coaxial transmission line as shown in FIG. 3. Transmission lines 312, 314, 316, 318, 320, and 322 may also have differing lengths depending on the intended phase relationships desired. In some examples, transmission lines 314, 316, 318, and 320 may have equal lengths.

Transmission-line sub-network 310 may also include one or more ferrite sleeves, such as a first ferrite sleeve 332 extending around transmission lines 312, 314, and 316, a second ferrite sleeve 334 extending around transmission lines 318, 320, and 322, a third ferrite sleeve 336 extending around only transmission line 318 spaced from transmission line 322, and/or a fourth ferrite sleeve 338 extending around only transmission line 320 spaced from transmission line 322.

Transmission lines may be configured to form baluns, where an unbalanced signal exists at one end of the transmission line where the signal-return conductor is connected to circuit ground, and a balanced signal exists at the other end of the transmission line. The voltage difference between the signal and signal-return conductors stays the same along the transmission line, but the voltage on each conductor relative to ground gradually changes progressing from the unbalanced-signal end toward the balanced-signal end. At the balanced-signal end, the voltage relative to circuit ground on the signal conductor may be half the voltage on the signal conductor at the unbalanced-signal end, and the voltage on the signal-return conductor may be the negative complement of the voltage on the signal conductor. This arrangement leads to a voltage variation or gradient along the length of the transmission line relative to circuit ground, because the voltages on the signal conductor and the signal-return conductor transition between the different voltages at each end.

The structure of the balun may produce spurious signals between a conductor and circuit ground, which spurious signals may be choked by a ferrite sleeve extending around the conductor. A ferrite sleeve may be a block, bead, or ring, or layers of ferrite material may be configured as appropriate to suppress high frequency spurious signals, noise, or other signals relative to ground on the transmission line. Transmission lines having unshielded conductors with the same voltage to ground may use a common ferrite sleeve. Combining transmission lines in a single ferrite sleeve may reduce overall hysteresis losses caused by the ferrite.

The center conductor of a coaxial transmission line is also referred to herein as the signal conductor. Accordingly, the shield conductor surrounding the center conductor is also referred to below as the signal-return conductor.

To provide a frame of reference in the following description, one end of each of transmission lines 312, 314, 316, 318, and 320 are connected together at what is referred to as a junction 350. The ends of the transmission lines that are connected together at junction 350 are referred to as the first ends, and the ends opposite the first ends are referred to as the second ends. Using this terminology, sum port 324 is at the second end of the signal conductor 312A of transmission line 312; the connection of the second ends of signal conductors 316A and 318A via first resistive junction 327 forms component port 328; and the connection of the second ends of signal conductors 314A and 320A via second resistive junction 329 forms component port 330.

Furthermore, in the following discussion instantaneous voltages existing at each of the ports, depending upon the circuit application, are designated as follows: V(A) is at sum port 324, V(B) is at first component port 328, V(C) is at second component port 330, and V(D) is at difference port 326.

In this example of transmission-line sub-network 310, the first ends of signal-return conductors 312B, 314B, and 316B of the first, second, and third transmission lines, respectively, are connected together electrically by connecting the respective coaxial shields to one another.

The second end of first transmission line 312 forms sum port 324, the second end of second transmission line 314 is associated with second component port 330, and the second end of third transmission line 316 is associated with first component port 328. Signal-return conductors 312B, 314B, and 316B of these three transmission lines are connected to ground at their respective second ends. Since the signal-return conductors 312B, 314B, and 316B are each grounded at one end and connected together electrically at the other end, they have the same voltage with respect to ground and may be choked using the same ferrite sleeve, such as first ferrite sleeve 332.

In this example, the second end of signal conductor 312A is associated with sum port 324. The first end of signal conductor 312A may be connected in junction 350 at circuit node 352 to the first ends of signal conductor 318A and signal conductor 320A in a branching configuration as shown in FIG. 3. The first end of signal conductor 314A may be electrically connected to the first end of signal-return conductor 318B, for example by connecting the center conductor of second transmission line 314 in junction 350 to the shield of fourth transmission line 318. In similar fashion, the first end of signal conductor 316A may be electrically connected to the first end of signal-return conductor 320B, for example by connecting the center conductor of third transmission line 316 to the shield of fifth transmission line 320.

The first ends of fourth transmission line 318 and fifth transmission line 320 may be spaced electrically along a length to provide inductive coupling between signal-return conductor 318B and signal-return conductor 320B, forming thereby sixth transmission line 322. To facilitate this coupling, a layer of dielectric material, such as dielectric material 40 discussed in U.S. Pat. No. 8,493,162, may be disposed between the shields of fourth transmission line 318 and fifth transmission line 320. At least a portion of the transmission lines along the coupled lengths of transmission lines 318 and 320, and thereby along transmission line 322, may be surrounded by a ferrite sleeve, such as second ferrite sleeve 334.

Coupling the signal-return conductors of fourth transmission line 318 and fifth transmission line 320 in this fashion may create difference port 326.

Transmission line 322 formed by the shields of lines 318 and 320, with a possible dielectric material, enables relocating terminating resistance 354 to a location outside ferrite sleeve 334, thereby lowering the ferrite loss. The preferred implementation of junction 350 contains minimal interconnections between lines 312, 314, 316, 318 and 320, with an effectively continuous sleeve of ferrite 332, 334 surrounding it. As the termination 354 is now across from shield to shield, choking those shields with ferrite sleeves 336 and 338 prevents shorting out the termination as the shields connect to ground.

Impedance 354 may be in the form of a resistor 342. The shield-to-shield impedance of transmission line 322 between signal-return conductor 318B and signal-return conductor 320B may be 50 ohms, for example. Accordingly, resistor 342 may be a 50-ohm resistor.

With general reference to FIG. 3, second transmission line 314, third transmission line 316, fourth transmission line 318, and fifth transmission line 320 may each have a respective length. In order to provide appropriate signal phases at the respective ends of these transmission lines, for example, the combined lengths of lines 314 and 318 may be substantially the same as the combined lengths of lines 316 and 320. In some embodiments, the lengths of all four transmission lines may be substantially the same.

With the described configuration, transmission-line sub-network 300 may be utilized as either a divider or a combiner, depending on which port or ports have signals applied, and may be configured as a magic tee hybrid. In this regard, port 324 is a sum port, port 326 is a difference port, and ports 328 and 330 are component ports. As shown in FIG. 3, transmission-line sub-network 310 may include first and second transmission-line sub-networks 360, 362. In particular, first transmission-line sub-network 360 may include at least transmissions lines 316, 318. Transmission lines 316, 318 may have common respective characteristic impedances, and may have respective lengths corresponding to a quarter wavelength of a circuit operating frequency of network 300. Similarly, sub-network 362 may include at least transmission lines 314, 320. Transmission lines 314, 320 also may have common respective characteristic impedances, and may have respective lengths corresponding to the quarter wavelength.

Sub-network 360 and resistive junction 327 may form (or be included in) a first transmission-line network 361 extending between nodes 324, 328, in a manner similar to network 100 shown in FIG. 1. In particular, respective first ends (e.g., connected together in junction 350) of transmission lines 316, 318 may be connected electrically in series relative to circuit node 352. Respective second ends (e.g., opposite the ends connected together in junction 350) of transmission lines 316, 318 may be connected electrically in parallel relative to second circuit node 328.

Resistive junction 327 may include transmission lines 364, 366 and impedance assembly 368. Transmission line 364 may have a first end 364*a* directly connected to node 328. In particular, a first end 365*a* of a signal conductor 365 (e.g., a center conductor) of line 364 may be directly connected to node 328. Transmission line 364 may have a second end 364*b* electrically connected to the second end of transmission line 316. In particular, a second end 365*b* of signal conductor 365 of line 364 may be electrically connected to signal conductor 316A at the second end of line 316. Transmission line 366 may have a first end 366*a* directly connected to node 328. In particular, a first end 367*a* of a signal conductor 376 of line 366 may be directly connected to node 328. Transmission line 366 may have a second end 366*b* electrically connected to the second end of transmission line 318. In particular, a second end 367*b* of signal conductor 367 of line 366 may be electrically connected to signal conductor 318A at the second end of line 318.

Impedance assembly 368 may be disposed relative to transmission lines 364, 366. Impedance assembly 368 may be configured to produce resistance between second end 364*b* of transmission line 364 and second end 366*b* of transmission line 366. For example, impedance assembly 368 may include a resistor 370 configured to produce the resistance. In particular, resistor 370 may have first and second ends 370*a*, 370*b*. First end 370*a* may be electrically connected to second end 366*b* of line 366. Second end 370*b* may be electrically connected to second end 364*b* of line 364. For example, first end 370*a* may be directly connected to second end 367*b* of signal conductor 367, and second end 370*b* may be directly connected to second end 365*b* of signal conductor 365, as shown.

Further, transmission lines 364, 366 may include respective signal-return conductors (e.g., shield or outer conductors) 369, 371. Signal-return conductor 369 may be electromagnetically closely coupled to signal conductor 365. Signal-return conductor 369 may have first and second ends 369*a*, 369*b*, which may be connected to ground. Similarly, signal-return conductor 371 may be electromagnetically closely coupled to signal conductor 367, and may have first and second ends 371*a*, 371*b* connected to ground.

In some embodiments, transmission lines 364, 366 may have the same characteristic impedances. Further, the resistance produced by impedance assembly 368 between second ends 364*b*, 366*b* of respective transmission lines 364, 366 may be at least half the magnitude of the characteristic impedances of transmission lines 364, 366. More specifically, such resistance provided by impedance assembly 368 may be twice the magnitude of the characteristic impedance of each of transmission lines 364, 366.

In some embodiments, transmission lines 364, 366 may have an electrical length that is less than a quarter wavelength of the circuit operating frequency of network 300. More specifically, the electrical length of each of transmission lines 364, 366 may be less than one-tenth of a wavelength of the circuit operating frequency of network 300.

Similarly, sub-network 362 and resistive junction 329 may form (or be included in) a second transmission-line network extending between nodes 324, 330. In particular, respective first ends of transmission lines 314, 320 (e.g., connected together in junction 350) may be connected electrically in series relative to first circuit node 324. Respective second ends (e.g., opposite the ends connected together in junction 350) of transmission lines 314, 320 may be connected electrically in parallel relative to second circuit node 330.

Resistive junction 329 may include transmission lines 372, 374 and impedance assembly 376. Transmission line 372 may have a first end 372*a* directly connected to node 330. In particular, a first end 378*a* of a signal conductor 378 (e.g., a center conductor) of line 372 may be directly connected to node 330. Transmission line 372 may have a second end 372*b* electrically connected to the second end of transmission line 314. In particular, a second end 378*b* of signal conductor 378 may be electrically connected to signal conductor 314A at the second end of line 314. Transmission line 374 may have a first end 374*a* directly connected to node 330. In particular, a first end 380*a* of a signal conductor 380 of line 374 may be directly connected to node 330. Transmission line 374 may have a second end 374*b* electrically connected to the second end of transmission line 320. In particular, a second end 380*b* of signal conductor 380 may be electrically connected to signal conductor 320A at the second end of line 320.

Impedance assembly 376 may be disposed relative to transmission lines 372, 374. Impedance assembly 376 may be configured to produce resistance between second end 372*b* of transmission line 372 and second end 374*b* of transmission line 374. For example, impedance assembly 376 may include a resistor 382 configured to produce the resistance. In particular, resistor 382 may have first and second ends 382*a*, 382*b*. First end 382*a* may be electrically connected to second end 372*b* of line 372. Second end 382*b* may be electrically connected to second end 374*b* of line 374. For example, end 382*a* may be directly connected to end 378*b*, and end 382*b* may be directly connected to end 380*b*.

Further, transmission lines 372, 374 may include respective signal-return conductors (e.g., shield or outer conductors) 384, 386. Signal-return conductor 384 may be electromagnetically closely coupled to signal conductor 378, and may have first and second ends 384*a*, 384*b* that are connected to ground. Similarly, signal-return conductor 386 may be electromagnetically closely coupled to signal conductor 380, and may have first and second ends 386*a*, 386*b* that are connected to ground.

In some embodiments, transmission lines 372, 374 may have the same characteristic impedances. For example, lines 372, 374 may have the same characteristic impedances as lines 364, 366. Further, the resistance produced by impedance assembly 378 between second ends 372*b*, 374*b* of respective transmission lines 372, 374 may be at least half the magnitude of the characteristic impedances of transmission lines 372, 374. More specifically, such resistance provided by impedance assembly 376 may be twice the magnitude of the characteristic impedance of each of transmission lines 372, 374. For example, transmission lines 364, 366, 372, 374 may each have a characteristic impedance of 50-Ohms. Resistors 370, 382 may each have a resistance of 100-Ohms. Lengths of transmission lines 364, 366, 372, 374 may each be a quarter wavelength of a mid-band operational frequency of network 300.

In some embodiments, transmission lines 372, 374 may have an electrical length that is less than a quarter wavelength of the circuit operating frequency of network 300. More specifically, the electrical length of each of transmission lines 372, 374 may be less than one-tenth of a wavelength of the circuit operating frequency of network 300.

It should be appreciated that in the embodiment depicted in FIG. 3, nodes 324, 328, 330 may correspond to respective signal nodes. Connections to ground associated with the second ends of respective signal-return conductors (e.g., shield conductors) 314B, 316B may correspond to a signal-return node associated with signal node 324. Similarly, connections to ground associated with the respective shield conductors at first ends 364*a*, 366*a* of lines 364, 366 may correspond to a signal-return node associated with signal node 328. Further, connections to ground associated with the respective shield conductors at first ends 372*a*, 374*a* of lines 372, 374 may correspond to a signal-return node associated with signal node 330.

Figure 4:
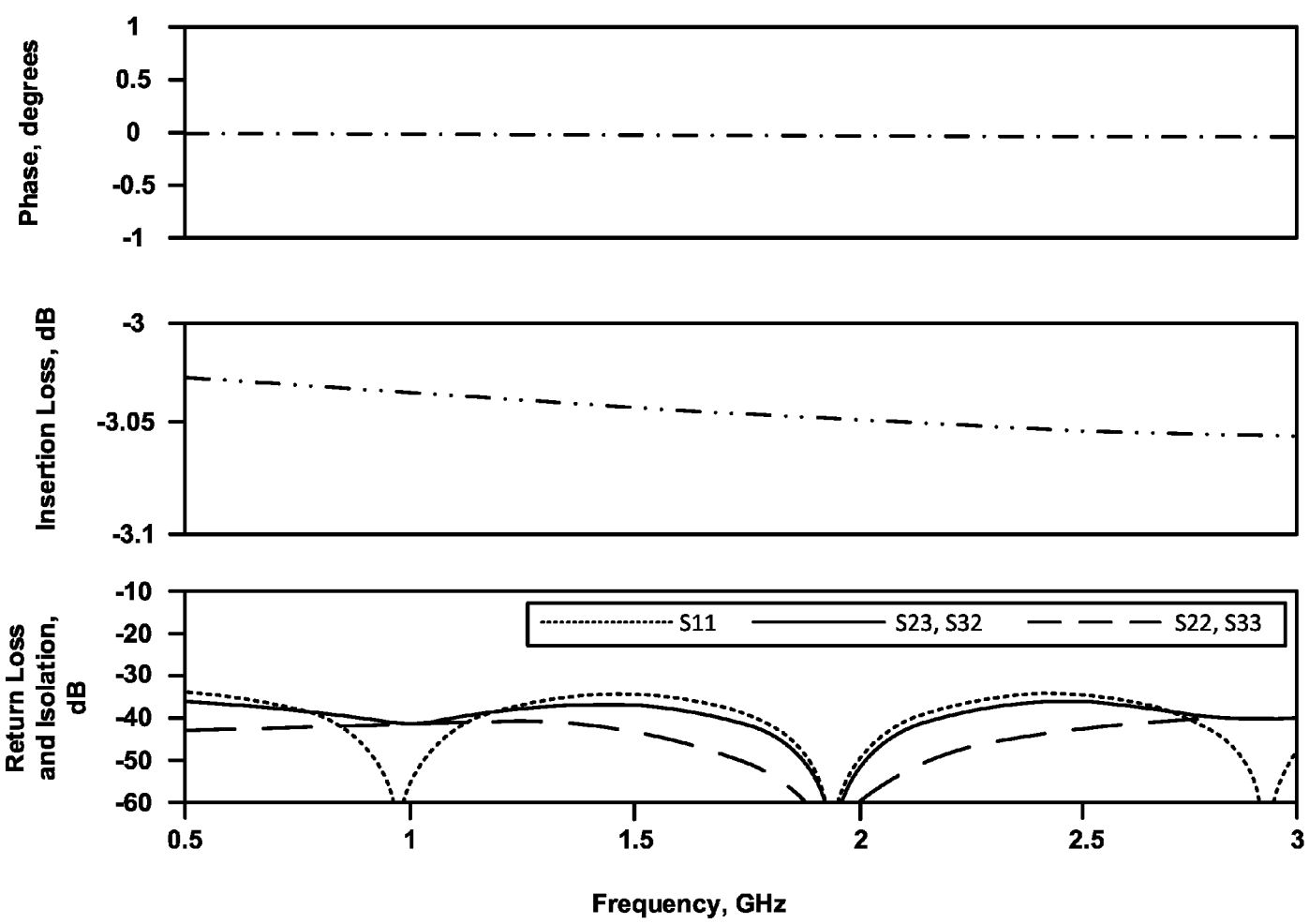
FIG. 4 is a chart illustrating simulated responses of the transmission-line network of FIG. 3.

FIG. 4 shows simulated responses of network 300. In FIG. 4, nodes 324, 328, 330 are identified as nodes 1, 2 and 3, respectively. It is seen that there is approximately zero phase difference between an input signal (e.g., on node 324) and an output signal (e.g., on either of nodes 328, 330) over the illustrated frequency range of 0.5 GHz to 3.0 GHz. Although not shown, the passband actually extends to DC. Also, the insertion loss (e.g., S21 and S31) is less than −3.05 dB. Further, the return losses (e.g., S11, S22, and S33) and the insertion losses (e.g., S23 and S32) are less than −30 dB over the passband. Moreover, the compensated responses of network 300 are free of any resonance up to and beyond 3 GHz. On the other hand, the combiner disclosed in U.S. Pat. No. 8,493,162 has a distinct resonance at 1.2 GHz.

FIG. 5 depicts an impedance transforming transmission-line network 400 extending between first, second, and third circuit nodes 402, 404, 406. Network 400 may include a transmission-line sub-network 407, a first resistive junction 409 coupling sub-network 407 to node 404, and a second resistive junction 410 coupling sub-network 407 to node 406. As shown, nodes 402, 404, 406 may include respective signal nodes 402*a*, 404*a*, 406*a*, and respective signal-return nodes 402*b*, 404*b*, 406*b*. Network 400 will be seen to provide a 2:1 impedance transformation form node 402 to nodes 404, 406. For example, if the impedance on node 402 if 50 ohms, the impedances on nodes 404, 406 will be 25 ohms.

Sub-network 407 may include transmission lines 408, 412, 414, 418. First resistive junction 409 may include transmission lines 420, 422 and a first impedance assembly 430. Second resistive junction 410 may include transmission lines 424, 426 and a second impedance assembly 432. Network 400 may further include a transmission line 434, an inductor (or inductance) 436, and a resistor (or resistance) 438. Transmission line 434 may serve as a balun that converts between an unbalanced signal on nodes 402*a*, 402*b* and a balanced signal on nodes N1, N2 described further below.

Each of the transmission lines may include a signal conductor and a signal return conductor, which may be electromagnetically closely coupled with one another (e.g., mutually inductively closely coupled). In particular, transmission line 408 may include a signal conductor 460 having first and second ends 460*a*, 460*b*. Line 408 may further include a first signal-return conductor 462 having first and second ends 462*a*, 462*b*, and a second signal-return conductor 464 having first and second ends 464*a*, 464*b*. As shown, ends 462*a* and 464*a* are connected together. Ends 462*b* and 464*b* are also connected together without connection to ground so that the voltage can float relative to ground.

Transmission line 412 may include a signal conductor 466 having first and second ends 466*a*, 466*b*. Line 412 may further include a signal-return conductor 468 having first and second ends 468*a*, 468*b*. Transmission line 434 may include a signal conductor 470 having first and second ends 470*a*, 470*b*. Line 434 may further include a signal-return conductor 472 having first and second ends 472*a*, 472*b*.

Transmission line 414 may include a signal conductor 474 having first and second ends 474*a*, 474*b*. Line 414 may further include a signal-return conductor 476 having first end 476*a*, and ungrounded second end 476*b*. Transmission line 418 may include first and second signal-return conductors 478, 480 having respective first ends 478*a*, 480*a*, and second ends 478*b*, 480*b*. Transmission line 418 may further include a signal conductor 482 having first and second ends 482*a*, 482*b*.

Lines 408, 412, 414, 418 may have common respective characteristic impedances and respective lengths corresponding to a quarter wavelength of a circuit operating frequency of network 400. Respective first ends 418*a*, 412*a* of transmission lines 418, 412 may be connected electrically in series relative to circuit node N1, for example. Node N1 may be connected to end 460*a* of signal conductor 460 and to end 482*a* of signal conductor 482. Node N2 may be connected to end 468*a* of signal-return conductor 468 and to end 476*a* of signal-return conductor 476. Node N3 may be connected to end 462*a* of signal-return node 462 and to end 466*a* of signal conductor 466. Node N4 may be connected to end 480*a* of signal-return conductor 480 and to end 474*a* of signal conductor 474. Thus in this example, a loop is formed from node N1 through transmission lines 408, 412, 414, and 418 and back to node N1, with these transmission lines connected in series in the loop.

Referring now to resistive junction 409, transmission line 420 may include a signal conductor 484 having first and second ends 484*a*, 484*b*. Line 420 may further include a signal-return conductor 486 having first and second ends 486*a*, 486*b*. Transmission line 422 may include a signal conductor 488 having first and second ends 488*a*, 488*b*. Line 422 may further include a signal-return conductor 490 having first and second ends 490*a*, 490*b*.

Transmission line 424 may include a signal conductor 492 having first and second ends 492*a*, 492*b*. Line 424 may further include a signal-return conductor 494 having first and second ends 494*a*, 494*b*. Transmission line 426 may include a signal conductor 496 having first and second ends 496*a*, 496*b*. Line 426 may further include a signal-return conductor 498 having first and second ends 498*a*, 498*b*.

Respective transmission lines 418, 412 may be connected electrically in parallel relative to node 404. In particular, end 466*b* of signal conductor 466 may be connected to signal node 404*a* via signal conductor 484. End 468*b* of signal-return conductor 468 may not be connected to ground so that the voltage is left floating relative to circuit ground. End 482*b* of signal conductor 482 may be connected to signal node 404*a* via signal conductor 488. End 480*b* of signal-return conductor 480 and end 478*b* of signal-return conductor 478 may be connected together but not connected to ground.

Transmission line 420 may have a first end 420*a* directly connected to node 404, and a second end 420*b* electrically connected to second end 412*b* of transmission line 412. In particular, end 484*a* may be directly connected to signal node 404*a*. End 486*a* may be directly connected to signal-return node 404*b* and to ground. End 484*b* may be connected to end 466*b*.

Similarly, transmission line 422 may have a first end 422*a* directly connected to node 404, and a second end 422*b* electrically connected to second end 418*b* of transmission line 418. In particular, end 488*a* may be directly connected to signal node 404*a*. End 490*a* may be directly connected to signal-return node 404*b* and to ground. End 488*b* may be connected (e.g., directly) to end 482*b*.

Impedance assembly 430 may be disposed relative to transmission lines 420, 422, and may be configured to produce resistance between second end 422*b* of line 422 and second end 420*b* of line 420. In particular, impedance assembly 430 may include a direct electrical connection 500 of end 484*b* to end 488*b*, and a resistor 502 electrically connected between end 486*b* and end 490*b*. For example, resistor 502 may have a first end directly connected to end 484*b*, and a second end directly connected to end 490*b*.

In some embodiments, impedance assembly 430 may include a ferrite assembly, such as a ferrite sleeve 504, which may substantially surround ends 486*b*, 490*b*, and may extend across a gap between ends 486*b*, 490*b*. In such embodiments, the ferrite assembly may provide resistance between outer conductor ends 486*b* and 490*b*, in which case, resistor 502 may not be included in assembly 430. In other examples not having a ferrite assembly, ends 486*b* and 490*b* are directly connected and a resistor connects center conductor ends 484*b* and 488*b*, as has been described with reference to the networks of FIGS. 1 and 3.

In some embodiments, transmission lines 420, 422 may have the same characteristic impedances. In such embodiments, the resistance produced by assembly 430 between ends 420*b*, 422*b* may be at least half the magnitude of the characteristic impedances of lines 420, 422. For example, the resistance produced may be twice the magnitude of the characteristic impedance of each of lines 420, 422.

In some embodiments, transmission lines 420, 422 may (each) have an electrical length that is less than a quarter wavelength of the circuit operating frequency of network 400. For example, lines 420, 422 may each have an electrical length that is less than one-tenth (e.g., 1/10) of a wavelength of the circuit operating frequency of network 400.

Additionally, lines 408, 414 may be connected electrically in parallel relative to node 406. In particular, end 460*b* of signal conductor 460 may be connected to signal node 406*a* via signal conductor 492. End 474*b* of signal conductor 474 may be connected to signal node 406*a* via signal conductor 496.

Transmission line 424 may have a first end 424*a* directly connected to node 406, and a second end 424*b* electrically connected to second end 408*b* of transmission line 408. In particular, end 492*a* of signal conductor 492 may be directly connected to signal node 406*a*. End 494*a* of signal-return conductor 494 may be directly connected to signal-return node 406*b* and to ground. End 492*b* of signal conductor 492 may be connected (e.g., directly) to end 460*b*.

Similarly, transmission line 426 may have a first end 426*a* directly connected to node 406, and a second end 426*b* electrically connected to second end 414*b* of transmission line 414. In particular, end 496*a* of signal conductor 496 may be directly connected to signal node 406*a*. End 498*a* of signal-return conductor 498 may be directly connected to signal-return node 406*b* and to ground. End 496*b* may be connected to end 474*b*.

Impedance assembly 432 may be disposed relative to transmission lines 424, 426, and may be configured to produce resistance between second end 426*b* of line 426 and second end 424*b* of line 424. In particular, impedance assembly 432 may include a direct electrical connection 510 of end 492*b* to end 496*b*, and a resistor 512 electrically connected between end 494*b* and end 498*b*. For example, resistor 512 may have a first end directly connected to end 494*b*, and a second end directly connected to end 498*b*. In some embodiments, impedance assembly 432 may include a ferrite assembly, such as a ferrite sleeve 514, which may substantially surround ends 494*b*, 498*b*, and may extend across a gap between ends 494*b*, 498*b*. In such embodiments, the ferrite assembly in combination with connection 510 may provide resistance between ends 426*b*, 424*b*, in which case, resistor 512 may not be included in assembly 432.

In some embodiments, transmission lines 424, 426 may have the same characteristic impedances. In such embodiments, the resistance produced by assembly 432 between ends 424*b*, 426*b* may be at least half the magnitude of the characteristic impedances of lines 424, 426. For example, the resistance produced by assembly 432 may be twice the magnitude of the characteristic impedance of each of lines 424, 426.

In some embodiments, transmission lines 424, 426 may have an electrical length that is less than a quarter wavelength of the circuit operating frequency of network 400. For example, lines 424, 426 may each have an electrical length that is less than one-tenth of a wavelength of the circuit operating frequency of network 400.

FIGS. 6-8 depict a planar stripline network 700. In particular, FIG. 6 is an isometric view of network 700. FIG. 7 is a detailed isometric view of a portion of a resistive junction J1 of network 700. FIG. 8 is a cross-section of an impedance assembly of resistive junction J1 taken along line 8-8 in FIG. 7.

As shown in FIG. 6, network 700 may include first and second ferrite layers 702, 704; first, second, third, fourth, and fifth metallic (or other conductive material) layers 706, 708, 710, 712, 714; and first, second, third, fourth, fifth, and sixth dielectric layers 716, 718, 720, 722, 724, 726.

Network 700 is an embodiment of network 400 depicted in FIG. 5. For example, network 700 may extend between first, second, and third circuit nodes 728, 730, 732 corresponding respectively to nodes 402, 404, 406 of network 400. Network 700 may include a transmission-line sub-network 731 and resistive junctions 733 and 735. Transmission lines in network 700 are planar and may be striplines. Specifically, network 700 may include an input, or balun transmission line 734 corresponding to transmission line 434 of network 400. Sub-network 731 may include transmission lines 736, 738, 744, 746, corresponding respectively to transmission lines 412, 414, 414, 408 of sub-network 407. In addition, resistive junction 733 may include transmission lines 740, 742 corresponding respectively to transmission lines 420, 422 of resistive junction 409. Resistive junction 735 may include transmission lines 748, 750 corresponding respectively to transmission lines 426, 424 of resistive junction 410.

In particular, stripline 734 may include a planar signal conductor 752 and opposing planar signal-return conductors 754, 756. Signal conductor 752 may be disposed between and electromagnetically closely coupled to signal-return conductors 754, 756. For example, signal conductor 752 may be included in layer 710, signal-return conductor 754 may be included in layer 708, and signal-return conductor 756 may be included in layer 712.

Similarly, the other striplines of network 700 may be transmission lines including respective signal conductors extending in a plane between respective opposing signal-return conductors. In particular, stripline 736 may include a planar signal conductor 758 disposed between and electromagnetically closely coupled to opposing planar signal-return conductors 760, 762. Stripline 738 may include a planar signal conductor 764 disposed between and electromagnetically closely coupled to opposing planar signal-return conductors 766, 768. Stripline 740 may include a planar signal conductor 770 disposed between and electromagnetically closely coupled to opposing planar signal-return conductors 772, 774. Stripline 742 may include a planar signal conductor 776 disposed between and electromagnetically closely coupled to opposing planar signal-return conductors 778, 780 (see FIG. 7). Stripline 744 may include a planar signal conductor 782 disposed between and electromagnetically closely coupled to opposing planar signal-return conductors 784, 786. Stripline 746 may include a planar signal conductor 788 disposed between and electromagnetically closely coupled to opposing planar signal-return conductors 790, 792. Stripline 748 may include a planar signal conductor 794 disposed between and electromagnetically closely coupled to opposing planar signal-return conductors 796, 798. Stripline 750 may include a planar signal conductor 800 disposed between and electromagnetically closely coupled to opposing planar signal-return conductors 802, 804.

While a large portion of the "bottom" signal-return conductors in FIGS. 6 and 7 are hidden due to the respective view perspectives, it should be appreciated that these "bottom" signal-return conductors may be similarly structured and spaced from one another as the corresponding "top" signal-return conductors. For example, "bottom" signal-return conductors 774, 780 may be structured as "mirror-images" of respectively corresponding "top" signal-return conductors 772, 778.

Further, opposing thread conductors, such as thread conductors 806, 808, may extend along opposing lateral sides of each of the respective stripline signal conductors and be connected to the respective opposing signal-return conductors by one or more electrically conductive vias 810. Such a configuration of thread conductors may improve an electromagnetic shielding of the associated signal conductors. The existence of the ferrite layers 702, 704 make connection of any vias to ground more complicated, so ground connections may be provided externally of network 700 at the input and output ports.

As can be seen, signal conductors 752, 758, 764, 770, 776, 782, 788, 794, 800, and the thread conductors may be included in intermediate layer 710. Signal-return conductors 754, 760, 766, 772, 778, 784, 790, 796, 802 may be included in layer 708. Signal-return conductors 756, 762, 768, 774, 780, 786, 792, 798, 804 may be included in layer 712.

A first end of signal conductor 752 may be connected to a signal node of circuit node 728. Respective first ends of signal-return conductors 754, 756 may be connected to a signal-return node of circuit node 728. A second end of signal conductor 752 may be connected to respective first ends of signal conductors 764, 788 in a junction J2. A second end of signal-return conductor 754 may be connected to respective first ends of signal-return conductors 760, 784 in a junction J3. Similarly, a second end of signal-return conductor 756 may be connected to respective first ends of signal-return conductors 762, 786 in junction J3.

A first end of signal conductor 758 may be connected to respective first ends of signal-return conductors 790, 792 in junction J2. Similarly, a first end of signal conductor 782 may be connected to respective first ends of signal-return conductors 766, 768 in junction J2. For example, junction J2 may include one or more electrically conductive vias 810 for connecting the first end of signal conductor 782 with the first ends of respective signal-return conductors 766, 768, and may further include one or more electrically conductive vias 810 for connecting the first end of signal conductors 758 with the first ends of respective signal-return conductors 790, 792. Examples of similar structures and configurations are disclosed in U.S. Pat. No. 8,648,669, which is hereby incorporated by reference in its entirety for all purposes.

Striplines 736, 738 may be coupled to circuit node 730 by respective striplines 740, 742. In particular, a second end of signal conductor 758 may be connected to a first end of signal conductor 770 in junction J1. A second end of signal conductor 770 may be directly connected to a signal node corresponding to circuit node 730. Respective second ends of signal-return conductors 760, 762 may be connected to respective first ends of signal-return conductors 772, 774 in junction J1. Respective second ends of signal-return conductors 772, 774 may be directly connected to a signal-return node corresponding to circuit node 730. Similarly, a second end of signal conductor 764 may be connected to a first end of signal conductor 776 in junction J1. A second end of signal conductor 776 may be directly connected to the signal node of circuit node 730. Respective second ends of signal-return conductors 766, 768 may be connected to respective first ends of signal-return conductors 778, 780 in junction J1. Respective second ends of signal-return conductors 778, 780 may be directly connected to the signal-return node corresponding to circuit node 730.

For example, in a junction J4, the respective second ends of signal conductors 776, 770 may be connected together and directly connected to the signal node corresponding to circuit node 730. Similarly, in junction J4, the respective second ends of signal-return conductors 778, 780, 772, 774 may be connected together and directly connected to the signal-return node corresponding to circuit node 730.

Striplines 748, 750 may similarly couple respective striplines 744, 746 to circuit node 732. In particular, a second end of signal conductor 782 may be connected to a first end of signal conductor 794 in a junction J5. Junction J5 may be similar in structure to junction J1, which will be described further below in more detail with reference to FIGS. 7 and 8. For example, in junction J5, respective second ends of signal-return conductors 784, 786 may be connected to respective first ends of signal-return conductors 796, 798. Similarly, in junction J5, a second end of signal conductor 788 may be connected to a first end of signal conductor 800, and respective second ends of signal-return conductors 790, 792 may be connected to respective first ends of signal-return conductors 802, 804. In a junction J6, respective second ends of signal conductors 794, 800 may be connected together and directly connected to a signal node corresponding to circuit node 732. Further, in junction J6, respective second ends of signal-return conductors 796, 798, 802, 804 may be connected together and directly connected to a signal-return node corresponding to circuit node 732.

In network 700, there may be signal conductors that are not shielded by signal-return conductors, such as in junctions (or junction regions) J1, J2, and J5. In these regions, a conductive plate, such as a copper plate, may be disposed above and below these regions to reduce losses and provide shielding. For example, network 700 may further include plates 820, 822 disposed respectively above and below junction J2. Similarly, network 700 may include plates 824, 826 disposed respectively above and below junction J5, and plates 828, 830 (see FIG. 7) disposed respectively above and below junction J1.

Network 700 may further include other conductive plates disposed above and below other transmission line portions and/or junction regions. For example, conductive plates 832, 834 may be disposed respectively above and below junction J4 proximal node 730. Conductive plates 836, 838 may be disposed respectively above and below an end of stripline 734 corresponding to node 728. Conductive plates 840, 842 may be disposed respectively above and below junction J6 proximal node 732. A conductive plate 844 may be disposed above adjacent respective portions of striplines 738, 746, and a conductive plate, which is not shown but may be similar to plate 844, may be disposed below the adjacent respective portions of striplines 738, 746 in a position corresponding with plate 844. Plates 820, 824, 828, 832, 836, 840, 844 may be made of a suitable conductive material, such as copper, and may be disposed (and/or included) in layer 706. Plates 822, 826, 830, 834, 838, 842, and the plate which may be disposed in the position correspondingly below plate 844 may be similarly disposed (and/or included) in layer 714, and may also be made of a suitable conductive material.

It is seen that transmission-line sub-network 731 may include at least first and second transmission lines, such as striplines 736, 738, 744, 746, which may have common respective characteristic impedances. Further, striplines 736, 738, 744, 746 may have respective lengths corresponding to a quarter wavelength of a circuit operating frequency of network 700. Respective first ends 736*a*, 738*a* of striplines 736, 738 (e.g., proximal junction J2) may be connected electrically in series relative to the first circuit node 728. Respective second ends 738*b*, 736*b* of striplines 738, 736 (e.g., proximal junction J1) may be connected electrically in parallel relative to second circuit node 730. Stripline 742 may have a first end 742*a* (e.g., proximal junction J4) directly connected to circuit node 730, and a second end 742*b* (e.g., proximal junction J1) electrically connected to second end 738*b* of stripline 738. Stripline 740 may have a first end 740*a* directly connected to circuit node 730, and a second end 740*b* electrically connected to second end 736*b* of stripline 736.

Resistive junction 733 may further include an impedance assembly 852 disposed relative to striplines 740, 742. Impedance assembly 852 may be configured to produce resistance between second end 742*b* of stripline 742 and second end 740*b* of stripline 740. For example, impedance assembly 852 may include a first ferrite assembly 854. The first ferrite assembly may substantially surround the respective ends of signal-return conductors 772, 774, 778, 780 (e.g., proximal and/or in junction J1), and may extend across one or more gaps therebetween, as will be described below in further detail. For example, the first ferrite assembly 854 may include associated portions of one or more of ferrite layers 702, 704, as shown in FIG. 8.

In particular, junction J1 is shown in FIG. 7 with plates 828, 830 and ferrite layers 702, 704 removed from the view to simplify the illustration. As described above, respective second ends of signal conductors 776, 770, which are referenced in FIG. 7 at 776*b*, 770*b*, may be directly connected to the signal node corresponding with circuit node 730 (see FIG. 6). Respective second ends of signal-return conductors 772, 774, 778, 780, which are referenced in FIG. 7 at 772*b*, 774*b*, 778*b*, 780*b*, may be directly connected to the signal-return node corresponding to circuit node 730 (see FIG. 6). The respective first ends of signal conductors 770, 776, which are referenced in FIG. 7 at 770*a*, 776*a*, may be directly connected together by a tie conductor 860. Tie conductor 860 may have a width W1 and a length L1. As shown, length L1 may be greater than width W1.

Respective ends 772*a*, 776*a* of signal-return conductors 772, 776 may be physically spaced apart by a gap G1. Gap G1 may be defined between (and/or extend between, and/or be formed by) respective edge portions of signal-return conductors 772, 778 having respective lengths L2.

In particular, gap G1 may have a width W2. Tie conductor 860 may be aligned with gap G1. For example, tie conductor 860 may extend across gap G1 in a space vertically spaced from but aligned with gap G1, as shown. In some embodiments, width W2 of gap G1 may be less than length L1 of tie conductor 860. In some embodiments, width W2 may be less than L2. In some embodiments, such as the one shown in FIG. 7, width W2 may be less than width W1.

Similarly, respective first ends of signal-return conductors 774, 780, referenced in FIG. 7 at 774*a*, 780*a*, may be physically spaced apart by a gap G2 (see FIG. 8) having a width W3. As shown, width W3 may be equal to width W2.

As also shown in FIG. 8, and as mentioned above, the first ferrite assembly 854 (e.g., including corresponding portions of opposite first and second ferrite layers 702, 704) may substantially surround conductor ends 778*a*, 772*a*, 774*a*, 780*a* of respective signal-return conductors 778, 772, 774, 780. In particular, ferrite layer 702 may extend across gap G1, ferrite layer 704 may extend across gap G2, and ends 742*b*, 740*b* of striplines may be disposed between ferrite layers 702, 704.

More specifically, striplines 742, 740 may be coplanar striplines, as shown. As described above, signal conductor 776 of stripline 742 may be disposed between respective opposing planar signal-return conductors 778, 780. Similarly, signal conductor 770 of stripline 740 may be disposed between respective opposing planar signal-return conductors 772, 774. Ends 778*a*, 772*a* of the respective pair of coplanar signal-return conductors 778, 772 may be spaced apart by a gap that may have the same width as gap G1. Similarly, ends 780*a*, 774*a* of the respective pair of coplanar signal-return conductors 780, 774 may be spaced apart by a gap that may have the same width as gap G2.

As can be seen in FIGS. 6 and 8, striplines 738, 736 may be coplanar with striplines 742, 740. Ferrite layers 702, 704 may extend along striplines 738, 736. Further, ferrite layers 702, 704 may extend along the other striplines of network 700, which may also be coplanar with striplines 738, 736.

As seen best in FIGS. 7 and 8, tie conductor 860 may be coplanar with, connected to, and extend between ends 776*a*, 770*a* of respective signal conductors 776, 770. As also shown, tie conductor 860 may extend across gap G1 between signal-return conductors 778, 772. Further, tie conductor 860 may extend across gap G2 between signal-return conductors 780, 774.

As shown in FIG. 6, network 700 is generally symmetrical about a plane extending normal to the planes of the conductors and extending along stripline 734. Accordingly, the discussion above regarding striplines 736, 738 of transmission line sub-network 731, and resistive junction 733 also apply to corresponding structure of striplines 744, 746 and resistive junction 735. In particular, striplines 744, 746 may be connected to stripline 734 in a similar fashion as striplines 736, 738 are connected to stripline 734. Similarly, striplines 748, 750 may be connected to respective striplines 744, 746 as striplines 736, 738 are to striplines 740, 742.

Details regarding junction J1 will now be described in continuing detail with reference to FIGS. 7 and 8. It should be appreciated that description regarding junction J1 may also describe corresponding elements of junction J5 and relationships thereof.

In particular, resistive junction 733, associated with circuit junction J1, may include transmission lines 740, 742, at least first and second tie signal-return conductors 900, 902, tie conductor 860, and ferrite assembly 854. Ferrite assembly 854 includes respective first and second ferrite portions 904, 906 of ferrite layers 702, 704.

Transmission line 740 may have a first characteristic impedance, and, as described above, may include a first signal conductor, such as signal conductor 770, and at least a first signal-return conductor, such as signal-return conductor 772. End 770*b* of first signal conductor 770 may be connected to a first signal node 910 (see FIG. 6), which may correspond to the signal node of circuit node 730. End 770*a* of first signal conductor 770 may be connected to a second signal node 912 (see FIG. 7). As also described above, first signal-return conductor 772 may be electromagnetically closely coupled to first signal conductor 770. End 772*b* of first signal-return conductor 772 may be connected to a first signal-return node 914 (see FIG. 6), which may correspond to the signal-return node of circuit node 730. End 772*b* of first signal-return conductor 772 may be connected to a second signal-return node 916 (see FIG. 7).

Transmission line 742 may also have the first characteristic impedance. Transmission line 742, as described above, may include a second signal conductor, such as signal conductor 776, and at least a second signal-return conductor, such as signal-return conductor 778. End 776*b* of second signal conductor 776 may be connected to first signal node 910. End 776*a* of second signal conductor 776 may be connected to a third signal node 918 (see FIG. 7). End 778*b* of second signal-return conductor 778 may be connected to first signal-return node 914. End 778*a* of second signal-return conductor 778 may be connected to a third signal-return node 920 (see FIG. 7).

As shown in FIGS. 6-8, an edge of second signal-return conductor 778 may be spaced from an adjacent edge of first signal-return conductor 772. Adjacent edges of ends 772*a*, 778*a* of respective first and second signal-return conductors 772, 778 may be physically spaced apart. In some embodiments, first and second signal conductors 772, 778 may each have a length less than three-tenths of a wavelength of an operating frequency of circuit junction J1 (e.g., which may correspond to an operating frequency of network 700). In some embodiments, respective lengths of transmission lines 740, 742 may be less than one-tenth of a wavelength of the operating frequency of circuit junction J1. As described above, second signal-return conductor 778 may be electromagnetically closely coupled to second signal conductor 776.

As shown in FIGS. 7 and 8, tie signal-return conductor 900 may extend between second and third signal-return nodes 916, 920, and may be discontinuous intermediate second and third signal-return nodes 916, 920 at respective gap G1. For example, tie signal-return conductor 900 may include first and second portions opposite one another relative to gap G1, as shown. Similarly, as shown in FIG. 8, a second tie signal-return conductor 902 may extend between second and third signal-return nodes 916, 920, and may be discontinuous intermediate second and third signal-return nodes 916, 920 at respective gap G2. For example, second tie signal-return conductor 902 may include first and second portions opposite one another relative to gap G2, as shown.

Tie conductor 860 may be an electrically conductive metal tie signal conductor. Tie signal conductor 860 may be connected to and may extend continuously between second and third signal nodes 912, 918. Further, tie signal conductor 860 may be disposed between first and second tie signal-return conductors 900, 902, which can be seen particularly well in FIG. 8.

As also shown in FIG. 8, first ferrite portion 904 may extend substantially along tie signal-return conductor 900 opposite tie signal conductor 860. Similarly, second ferrite portion 906 may extend substantially along second tie signal-return conductor 902 opposite tie signal conductor 860. Further, first and second ferrite portions 904, 906 may also extend along opposite sides of transmission lines 740, 742. For example, as shown in FIGS. 6 and 8, first ferrite portion 904 may extend along "top" sides of transmission lines 740, 742, and second ferrite portion 906 may extend along "bottom" sides of transmission lines 740, 742.

As shown and as described above, first and second transmission lines 740, 742 may be striplines with respective signal conductors 770, 776 and signal-return conductors 772, 778 being planar. As similarly described above, transmission line 740 may include a second planar signal-return conductor, such as signal-return conductor 774. Signal-return conductor 774 may be electromagnetically closely coupled to signal conductor 770. Signal conductor 770 may be disposed between signal-return conductors 772, 774.

As also shown and as described above, transmission line 742 may further include a second planar signal-return conductor, such as signal-return conductor 780. Signal-return conductor 780 may be electromagnetically closely coupled to signal conductor 776. Signal conductor 776 may be disposed between signal-return conductors 780, 782. Ends 774*b*, 780*b* of respective signal-return conductors 774, 780 may be connected to a signal-return node 930, which may correspond to the signal-return node of circuit node 730. End 774*a* of signal-return conductor 774 may be connected to a signal-return node 940 (see FIG. 8). End 780*a* of signal-return conductor 780 may be connected to a signal-return node 942. As shown in FIG. 8, nodes 940, 942 may be spaced-apart, being separated by tie signal-return conductor 902.

In some embodiments, node 940 may be the same node as node 916. For example, nodes 940, 916 may correspond to a position along the respective transmission line corresponding to an electrically conductive via 945, which may directly electrically interconnect signal-return conductors 772, 774 such that nodes 940, 916 are at the same voltage. Similarly, nodes 920, 942 may correspond to the same signal-return node. In a similar fashion, nodes 914, 930 may be the same signal-return node. For example, as described above, nodes 914, 930 may correspond to the signal-return node of circuit node 730.

As shown in FIG. 8, ends 774*a*, 780*a* of respective signal-return conductors 774, 780 may be coplanar. First ferrite portion 904 may further extend along first and second signal-return conductors 772, 778 opposite respective signal conductors 770, 776. Similarly, second ferrite portion 906 may extend along signal-return conductors 774, 780 opposite respective signal conductors 770, 776.

In particular, first and second ferrite portions 904, 906 may be portions of first and second ferrite layers 702, 704. Tie signal conductor 860 and at least respective portions of signal-return conductors 772, 778, 774, 780 may be disposed between first and second ferrite layers 702, 704.

In some embodiments, such as the one depicted in FIGS. 6-8, resistive junctions (e.g., junctions 733 and 735) may be realized on a multi-layer printed circuit board (PCB) along with flat ferrite slabs (e.g., layers 702, 704) on both sides. For example, the PCB may include layers 706-726. The presence of the ferrite slabs may ensure a low frequency response of network 700, much like the effect of ferrite sleeves around a semi-rigid coax, and may improve the thermal performance of the PCB. However, such a planar design, which is sandwiched between two ferrite slabs, as shown in FIGS. 6-8, may not be compatible with the installment of discrete resistors. For example, if openings were created in the ferrite slabs, they may unnecessarily complicate the junctions, may make the slabs more expensive, may compromise the thermal performance of network 700, and/or may compromise the mechanical integrity of the slabs. For these reasons, the layout depicted in FIGS. 6-8 shows a construction of a network including what may be referred to as 'inside-out' resistive junctions. As the name suggests, an inside-out resistive junction may not include a floating resistor (or resistance) connected between inner signal conductors, but may bring such a connection to the outer signal-return conductors. This inside-out connection allows the resistive loading of the junction to be made at a more accessible location, such as the outside jacket of a rectangular coax structure (e.g., such as that formed at least in part by opposing signal-return conductors of a stripline). Further, the inside-out connection may allow the resistive loading of the junction to be realized, not with the use of a physical discrete resistor, but by exploiting the lossy nature of the ferrite slabs substantially surrounding the PCB. As a result, an inside-out resistive junction may employ no physical resistor at all, but instead make use of the ferrite slabs to eliminate ill effects due to self-resonance.

Figure 9:
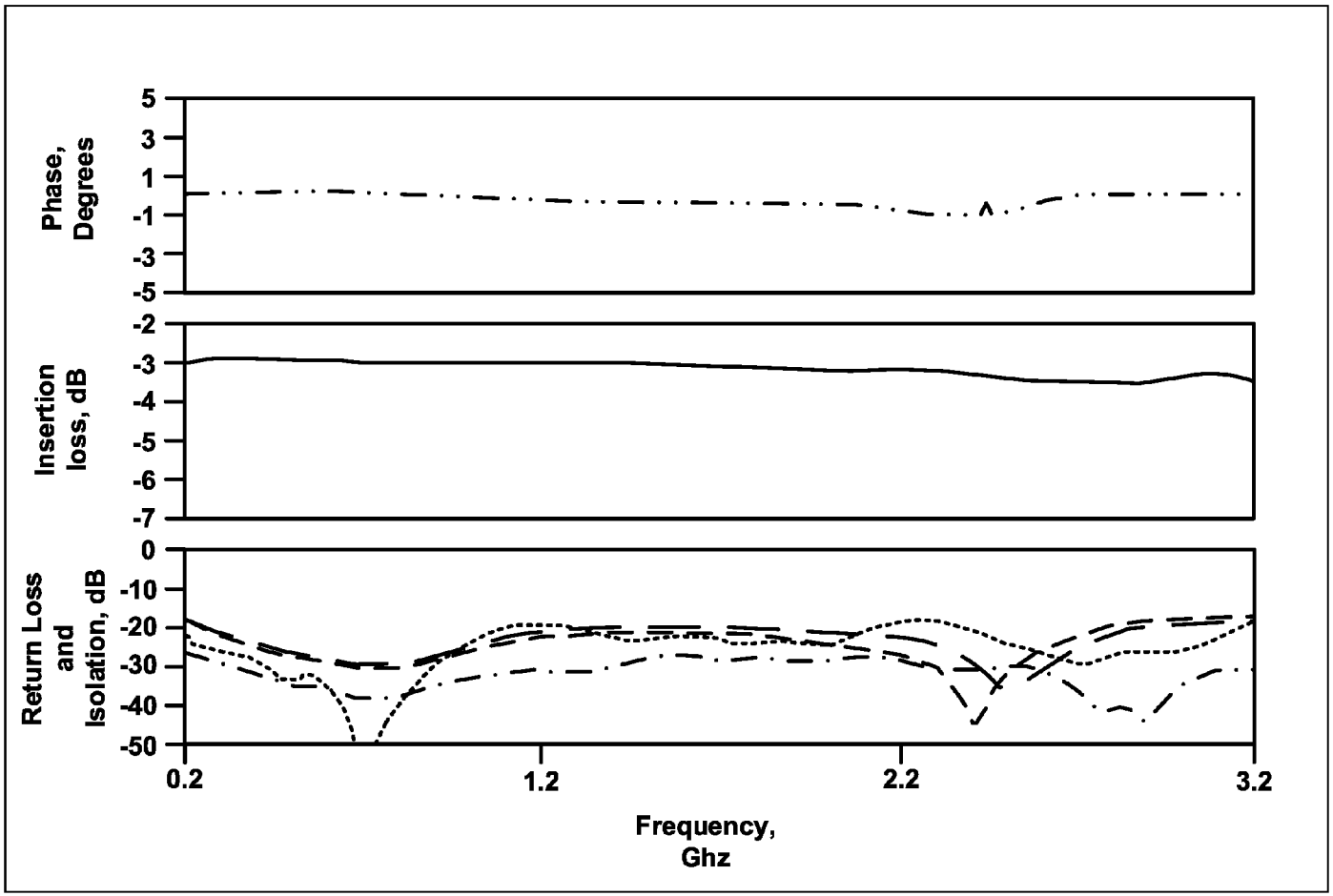
FIG. 9 is a chart illustrating simulated responses of the transmission-line network of FIG. 6.

FIG. 9 shows simulated responses of network 700. It is seen that there is approximately zero phase difference between an input signal (e.g., on node 728 as input port) and an output signal (e.g., on either of nodes 730, 732 as output ports) over much of a passband having a frequency range of 0.2 GHz to 3.2 GHz. Also, the insertion loss is close to −3.0 dB and does not exhibit any resonances across the frequency band. Further, the return losses (e.g., depicted as the long, medium, and short dash traces corresponding to the three ports in the bottom chart) and the isolation between the output ports corresponding to nodes 730 and 732 (e.g., depicted as the dash dot trace in the bottom chart) are for the most part less than −20 dB over the shown 1:16 bandwidth.

Figure 10:
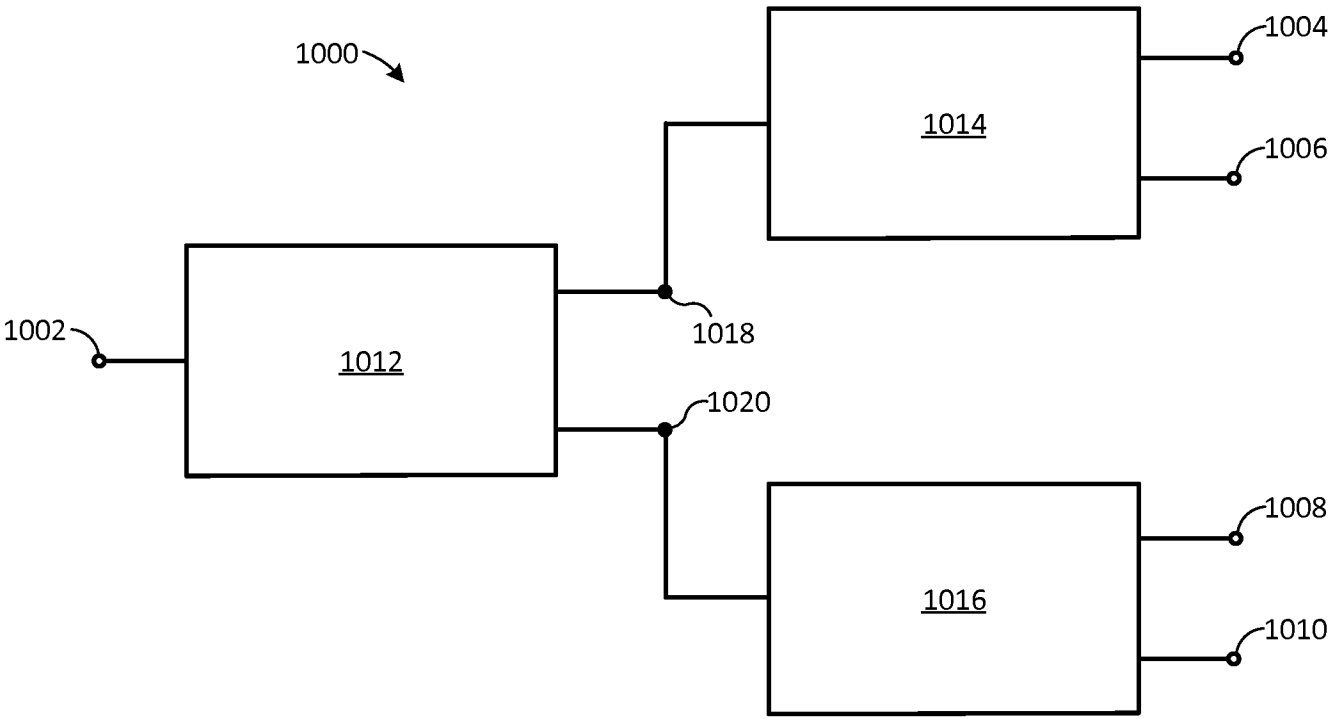
FIG. 10 is a block diagram of an example of a four-way combiner including a resistive-junction based combiner as provided by the networks of FIG. 3 or FIG. 5.

FIG. 10 depicts a four-way combiner 1000. As shown, network 1000 may extend between a terminal sum circuit node or port 1002, and second, third, fourth, and fifth terminal component circuit nodes or ports 1004, 1006, 1008, and 1010. Network 1000 may include a first resistive-junction-based two-way combiner 1012, and second and third two-way combiners 1014, 1016. Combiner network 1012 may be a transmission-line network, such as network 300 illustrated in FIG. 3 or network 400 illustrated in FIG. 5. Network 1012 may couple terminal sum circuit node 1002 to combiner 1014 via a first component intermediate circuit node 1018 and to network 1016 via a second component intermediate circuit node 1020.

Accordingly, network 1000 may be a low loss 4-way combiner in which all five terminal ports (e.g., nodes 1002, 1004, 1006, 1008, 1010) may be matched to the same characteristic impedance. For example, combiner network 1012 may provide a 2:1 impedance transforming ratio from the terminal sum circuit node 1002 to intermediate circuit nodes 1018, 1020. Combiners 1014 and network 1016 may each be similar to the circuit described in U.S. Pat. No. 6,246,299, in which a 1:2 impedance transforming ratio is provided from each intermediate circuit node as a sum port to the two respective terminal component circuit nodes or ports. The net result forms a new topology for realizing extremely low loss four-way combiners over a wide bandwidth of coverage.

The above descriptions are intended to be illustrative and not restrictive. Many other embodiments will be apparent to those skilled in the art, upon reviewing the above description. The scope of the inventions should therefore be determined with reference to the appended claims, along with the full scope of equivalents to which such claims are entitled. Accordingly, while various embodiments have been particularly shown and described, many variations may be made therein. This disclosure may include one or more independent or interdependent inventions directed to various combinations of features, functions, elements and/or properties, one or more of which may be defined in the following claims. Other combinations and sub-combinations of features, functions, elements and/or properties may be claimed later in this or a related application. Such variations, whether they are directed to different combinations or directed to the same combinations, whether different, broader, narrower or equal in scope, are also regarded as included within the subject matter of the present disclosure.

An appreciation of the availability or significance of claims not presently claimed may not be presently realized. Accordingly, the foregoing embodiments are illustrative, and no single feature or element, or combination thereof, is essential to all possible combinations that may be claimed in this or a later application. Each claim defines an invention disclosed in the foregoing disclosure, but any one claim does not necessarily encompass all features or combinations that may be claimed. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated. Ordinal indicators may be applied to associated elements in the order in which they are introduced in a given context, and the ordinal indicators for such elements may be different in different contexts.

What is claimed is:

1. A transmission-line network extending between first and second circuit nodes, the transmission-line network comprising:

a transmission-line sub-network including at least first and second transmission lines having common respective characteristic impedances and having respective lengths corresponding to a quarter wavelength of a circuit operating frequency of the transmission-line network, each transmission line having a first end, a second end, a signal conductor, and a signal-return conductor, the first circuit node being directly connected to the signal conductor at the first end of the first transmission line, respective first ends of the first and second transmission lines being connected electrically in series between the first circuit node and the signal-return conductor at the first end of the second transmission line, the signal-return conductor at the first end of the first transmission line being connected to the signal conductor at the first end of the second transmission line, and respective second ends of the first and second transmission lines being connected electrically in parallel from the second circuit node;

a third transmission line having a signal conductor at a first end directly connected to the second circuit node and the signal conductor at a second end directly connected to the signal conductor at the second end of the first transmission line;

a fourth transmission line having a signal conductor at a first end directly connected to the second circuit node and the signal conductor at a second end directly connected to the signal conductor at the second end of the second transmission line; and an impedance assembly disposed relative to the third and fourth transmission lines configured to produce a resistance between the second end of the third transmission line and the second end of the fourth transmission line.

2. The transmission line network of claim 1, wherein the third and fourth transmission lines have the same characteristic impedances, and the resistance is at least half the magnitude of the characteristic impedances of the third and fourth transmission lines.

3. The transmission line network of claim 2, wherein the resistance is twice the magnitude of the characteristic impedance of each of the third and fourth transmission lines.

4. The transmission line network of claim 1, wherein the third and fourth transmission lines have an electrical length that is less than a quarter wavelength of the circuit operating frequency.

5. The transmission line network of claim 4, wherein the third and fourth transmission lines each have an electrical length that is less than one tenth of a wavelength of the circuit operating frequency.

6. The transmission line network of claim 1, wherein each of the third and fourth transmission lines has a signal-return conductor, a first end of each of the signal-return conductors of the third and fourth transmission lines is directly connected to a first signal-return node corresponding to the second circuit node, second ends of the signal conductors of the third and fourth transmission lines are directly connected together by a tie conductor, and respective second ends of the signal-return conductors of the third and fourth transmission lines are physically spaced apart by a gap, the impedance assembly further comprising a ferrite assembly substantially surrounding the second ends of the signal-return conductors of the third and fourth transmission lines and extending across the gap between the second ends of the signal-return conductors of the third and fourth transmission lines.

7. The transmission line network of claim 6, wherein the third and fourth transmission lines are coplanar striplines with the respective planar signal conductors disposed between respective opposing planar signal-return conductors, the second ends of each pair of coplanar signal-return conductors of the third and fourth transmission lines being spaced apart by the gap, the ferrite assembly including opposite first and second ferrite layers with the second ends of the third and fourth transmission lines being disposed between the first and second ferrite layers.

8. The transmission line network of claim 7, wherein the first and second transmission lines are also striplines that are coplanar with the third and fourth striplines, and the first and second ferrite layers also extend along the first and second transmission lines.

9. The transmission line network of claim 8, wherein the tie conductor is coplanar with, connected to, and extends between the second ends of the signal conductors of the third and fourth transmission lines and across the gaps between the respective second ends of the signal-return conductors of the third and fourth transmission lines.

10. The transmission line network of claim 1, wherein the transmission-line sub-network includes a plurality of transmission lines in addition to the first and second transmission lines.

11. A transmission-line network extending between first and second circuit nodes, the transmission-line network comprising:

a transmission-line sub-network including at least first and second transmission lines having common respective characteristic impedances and having respective lengths corresponding to a quarter wavelength of a circuit operating frequency of the transmission-line network, respective first ends of the first and second transmission lines being connected electrically in series relative to the first circuit node and respective second ends of the first and second transmission lines being connected electrically in parallel relative to the second circuit node;

a third transmission line having a first end directly connected to the second circuit node and a second end electrically connected to the second end of the first transmission line;

a fourth transmission line having a first end directly connected to the second circuit node and a second end electrically connected to the second end of the second transmission line, the third and fourth transmission lines have the same characteristic impedances; and an impedance assembly disposed relative to the third and fourth transmission lines configured to produce a resistance between the second end of the third transmission line and the second end of the fourth transmission line, the resistance being twice the magnitude of the characteristic impedance of each of the third and fourth transmission lines.

12. A circuit junction comprising:

a first transmission line having a first characteristic impedance and including a first signal conductor and at least a first signal-return conductor, the first signal conductor having a first end connected to a first signal node and a second end connected to a second signal node, the first signal-return conductor being electromagnetically closely coupled to the first signal conductor and having a first end connected to a first signal-return node and a second end connected to a second signal-return node;

a second transmission line also having the first characteristic impedance and including a second signal conductor and at least a second signal-return conductor, the second signal conductor having a first end connected to the first signal node and a second end connected to a third signal node, and the second signal-return conductor having a first end connected to the first signal-return node and a second end connected to a third signal-return node, the second signal-return conductor being spaced from the first signal-return conductor and being electromagnetically closely coupled to the second signal conductor, the second ends of the first and second signal-return conductors being physically spaced apart, the first and second signal conductors each having a length less than three-tenths of a wavelength of an operating frequency of the circuit junction;

at least first and second tie signal-return conductors, each tie signal-return conductor extending between the second and third signal-return nodes and being discontinuous intermediate the second and third signal-return nodes at a respective gap;

an electrically conductive metal tie signal conductor connected to and extending continuously between the second and third signal nodes and extending between the first and second tie signal-return conductors; and a ferrite assembly including at least first and second ferrite portions, the first ferrite portion extending substantially along the first tie signal-return conductor opposite the tie signal conductor, and the second ferrite portion extending substantially along the second tie signal-return conductor opposite the tie signal conductor.

13. The circuit junction of claim 12, wherein the lengths of the first and second signal conductors are less than one-tenth of a wavelength of the operating frequency of the circuit junction.

14. The circuit junction of claim 12, wherein the first and second ferrite portions also extend along opposite sides of the first and second transmission lines.

15. The circuit junction of claim 12, wherein the first and second transmission lines are striplines, the first and second signal conductors and first and second signal-return conductors are planar, the first transmission line further including a planar third signal-return conductor electromagnetically closely coupled to the first signal conductor, the first signal conductor being disposed between the first and third signal-return conductors, the second transmission line further including a planar fourth signal-return conductor electromagnetically closely coupled to the second signal conductor, the second signal conductor being disposed between the second and fourth signal-return conductors, the third and fourth signal-return conductors having respective first ends connected to a fourth signal-return node and second ends connected to respective fifth and sixth spaced-apart nodes, the second ends of the third and fourth signal-return conductors being coplanar, and the first ferrite portion further extending along the first and second signal-return conductors opposite the respective first and second signal conductors, and the second ferrite portion further extending along the third and fourth signal-return conductors opposite the respective first and second signal conductors.

16. The circuit junction of claim 15, wherein the tie signal conductor is coplanar with the first and second signal conductors and extends through a region between the gaps of the first and second tie signal-return conductors.

17. The circuit junction of claim 15, wherein the first and second ferrite portions are first and second ferrite layers, with the tie signal conductor and at least respective portions of the first, second, third, and fourth signal-return conductors being disposed between the first and second ferrite layers.

18. A transmission-line network extending between first and second circuit nodes, the transmission-line network comprising:

a transmission-line sub-network including at least first and second transmission lines having common respective characteristic impedances and having respective lengths corresponding to a quarter wavelength of a circuit operating frequency of the transmission-line network, respective first ends of the first and second transmission lines being connected electrically in series relative to the first circuit node and respective second ends of the first and second transmission lines being connected electrically in parallel relative to the second circuit node;

a third transmission line having a first end directly connected to the second circuit node and a second end electrically connected to the second end of the first transmission line;

a fourth transmission line having a first end directly connected to the second circuit node and a second end electrically connected to the second end of the second transmission line;

each of the first, second, third, and fourth transmission lines having a signal conductor and a signal return conductor that are electromagnetically closely coupled, a first end of each of the signal conductors of the third and fourth transmission lines being directly connected to a first signal node corresponding to the second circuit node and a first end of each of the signal-return conductors of the third and fourth transmission lines being directly connected to a first signal-return node corresponding to the second circuit node; and an impedance assembly disposed relative to the third and fourth transmission lines configured to produce a resistance between the second end of the third transmission line and the second end of the fourth transmission line, the impedance assembly including a tie conductor directly connecting second ends of the signal conductors of the third and fourth transmission lines, with respective second ends of the signal-return conductors of the third and fourth transmission lines being physically spaced apart by a gap, and a ferrite assembly substantially surrounding the second ends of the signal-return conductors of the third and fourth transmission lines and extending across the gap between the second ends of the signal-return conductors of the third and fourth transmission lines.

19. The transmission line network of claim 18, wherein the third and fourth transmission lines are coplanar striplines with the respective planar signal conductors disposed between respective opposing planar signal-return conductors, the second ends of each pair of coplanar signal-return conductors of the third and fourth transmission lines being spaced apart by the gap, the ferrite assembly including opposite first and second ferrite layers with the second ends of the third and fourth transmission lines being disposed between the first and second ferrite layers.

20. The transmission line network of claim 19, wherein the first and second transmission lines are also striplines that are coplanar with the third and fourth striplines, and the first and second ferrite layers also extend along the first and second transmission lines.

21. The transmission line network of claim 20, wherein the tie conductor is coplanar with, connected to, and extends between the second ends of the signal conductors of the third and fourth transmission lines and across the gap between the respective second ends of the signal-return conductors of the third and fourth transmission lines.

* * * * *